US011036169B2

(12) United States Patent
Watanabe et al.

(10) Patent No.: US 11,036,169 B2
(45) Date of Patent: Jun. 15, 2021

(54) FIXING DEVICE

(71) Applicant: CANON KABUSHIKI KAISHA, Tokyo (JP)

(72) Inventors: Toshiyuki Watanabe, Yokohama (JP); Masafumi Maeda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/871,327

(22) Filed: May 11, 2020

(65) Prior Publication Data

US 2020/0363761 A1 Nov. 19, 2020

(30) Foreign Application Priority Data

May 16, 2019 (JP) ..... JP2019-093232

(51) Int. Cl.
*G03G 15/20* (2006.01)

(52) U.S. Cl.
CPC ..... *G03G 15/2053* (2013.01); *G03G 15/2064* (2013.01); *G03G 2215/2025* (2013.01)

(58) Field of Classification Search
CPC ..... G03G 15/2017; G03G 15/2039; G03G 15/2042; G03G 15/2046; G03G 15/2053; G03G 2215/2003; G03G 2215/2035
See application file for complete search history.

(56) References Cited

U.S. PATENT DOCUMENTS

2015/0338803 A1* 11/2015 Hirose ..... G03G 15/2053 399/329
2016/0139551 A1* 5/2016 Narahara ..... G03G 15/55 399/33

FOREIGN PATENT DOCUMENTS

JP H1184919 A 3/1999
JP 2016095397 A 5/2016

* cited by examiner

*Primary Examiner* — Thomas S Giampaolo, II
(74) *Attorney, Agent, or Firm* — Canon U.S.A., Inc., IP Division

(57) ABSTRACT

A fixing device includes a cylindrical film, a support member disposed on an inner peripheral surface of the film, a heating member supported by the support member and provided slidably with the film, and a pressing member that forms a pressure contact portion together with the heating member through the film. The fixing device heats a recording medium while pressing the recording medium at the pressure contact portion. A first thermally conductive member and a second thermally conductive member are provided between the heating member and the support member. The first and second thermally conductive members having thermal conductivity higher than that of the support member are configured to engage with each other.

10 Claims, 14 Drawing Sheets

FIXING DEVICE

BACKGROUND OF THE DISCLOSURE

Field of the Disclosure

The present disclosure relates to a fixing device used in an image forming apparatus, such as a copying machine or a laser beam printer (LBP), which employs an image formation process using, for example, an electrophotographic method, and an electrostatic recording method

Description of the Related Art

A film fixing method has been used for a fixing device included in an image forming apparatus that employs, for example, an electrophotographic method, and an electrostatic recording method. In a fixing device that employs the film fixing method, a fixing film and a pressing member are disposed in pressure contact with each other. Inside the fixing film, a heating member for heating the fixing film is disposed while the fixing film is driven in close contact with the pressing member at an inner surface of a portion opposed to the pressing member.

As the heating member, a ceramic heater having a structure in which a heating resistor element is formed on a substrate made of a ceramic material, such as alumina or aluminum nitride, is typically used. In a film heat fixing unit including the heating member, a phenomenon in which the temperature in a non-sheet-passing area of a heater through which paper does not pass becomes higher than the temperature in a sheet-passing area of the heater through which paper passes, i.e., a so-called non-sheet-passing-portion temperature rise, is likely to occur. Thus, the substrate of the heater can be broken by a thermal stress caused due to a temperature difference between the sheet-passing area and the non-sheet-passing area when the non-sheet-passing-portion temperature rise occurs. In this regard, there is a known structure in which a thermally conductive member is provided between a heater and a heater support member so as to facilitate heat transfer within the surface of the heater and obtain a substantially uniform temperature distribution in a longitudinal direction of the heater (Japanese Patent Application Laid-Open No. 11-84919).

On the other hand, the thermally conductive member can be deformed due to a difference between a thermal expansion amount (thermal expansion rate) of the heater and that of the thermally conductive member in a case the thermally conductive member between the heater and the heater support member are provided. Since the heater repeatedly performs heating and cooling (heat cycle), the heater and the heater support member repeatedly expand and contract. Accordingly, the heater and the heater support member exert forces on each other, so that a stress is applied to each of the heater and the heater support member. As a result, if a low-strength material, such as an aluminum plate, is used as the thermally conductive member, the thermally conductive member can be deformed due to the applied stress. If the thermally conductive member is deformed, adhesion properties between the thermally conductive member and the heater can deteriorate and the effect of temperature leveling caused by the thermally conductive member may be reduced. In order to prevent deformation of the thermally conductive member due to the heat cycle, there has been a technique for preventing deformation due to the heat cycle by arranging a plurality of members as thermally conductive members in the longitudinal direction (Japanese Patent Application Laid-Open No. 2016-95397). The use of thermally conductive members consisting of the plurality of members reduces the length of each of the thermally conductive members in the longitudinal direction. This reduction reduces an expansion amount of the thermally conductive members, and thereby alleviating the stress applied to the thermally conductive members due to the heat cycle and preventing deformation of the thermally conductive members.

However, in a case of using the plurality of members arranged as thermally conductive members in the longitudinal direction, the effect of leveling the temperature distribution in the longitudinal direction of the heater by the thermally conductive members cannot be obtained in a gap formed between the members of the thermally conductive members. Specifically, the thermally conductive members are not present at the gap, and thus the temperature of the heater rises locally, which may cause a defective image such as hot offset corresponding to the width of the gap (length in the longitudinal direction of the heater). Thus, a width of the gap may be desirably minimized. On the other hand, since the thermally conductive members thermally expand, the gap may desirably have a constant width to prevent deformation of the thermally conductive members due to the contact between adjacent thermally conductive members.

Thus, in order to minimize the width of the gap in consideration of thermal expansion, the thermally conductive member to engage with the heater support member can be located at a position as close to the gap as possible. This is because the thermal expansion amount of the thermally conductive member can be reduced by reducing the distance of the engagement portion from the gap. However, for example, in a case where a temperature detection element, a safety element, or the like is disposed in contact with the heater at a position close to the gap, there may be a case where a portion with a shape that allows the thermally conductive member to engage with the heater support member cannot be disposed near the gap.

SUMMARY OF THE DISCLOSURE

The present disclosure is directed to providing a fixing device capable of preventing the occurrence of a defective image by suppressing a local temperature rise in a heating member at a gap between adjacent thermally conductive members, while preventing deformation of the thermally conductive members due to a contact between the adjacent thermally conductive members in the fixing device including thermally conductive members composed of a plurality of members arranged in a longitudinal direction.

According to an aspect of the present disclosure, a fixing device includes a cylindrical film, a support member disposed on an inner peripheral surface of the film, a heating member supported by the support member and provided slidably with the film, and a pressing member that forms a pressure contact portion together with the heating member through the film, the pressure contact portion being configured to heat a recording medium while pressing the recording medium. A first thermally conductive member and a second thermally conductive member are provided between the heating member and the support member, each of the first thermally conductive member and the second thermally conductive member having thermal conductivity higher than thermal conductivity of the support member. The first thermally conductive member and the second thermally conductive member are configured to engage with each other.

Further features and aspects of the present disclosure will become apparent from the following description of example embodiments with reference to the attached drawings.

DESCRIPTION OF THE EMBODIMENTS

A first example embodiment according to the present disclosure will be described with reference to the accompanying drawings. First, an outline of a fixing device according to the present example embodiment will be described. Next, features of the present example embodiment will be described. In the following description, unless otherwise specified, a longitudinal direction of a fixing device 18 that is identical to an axial direction of a pressing roller 32 and a generatrix direction of a film 36 is simply referred to as a "longitudinal direction". A transverse direction of the fixing device 18 that is identical to a conveyance direction of a recording medium is simply referred to as a "transverse direction".

(Example Fixing Device)

Figure 1:
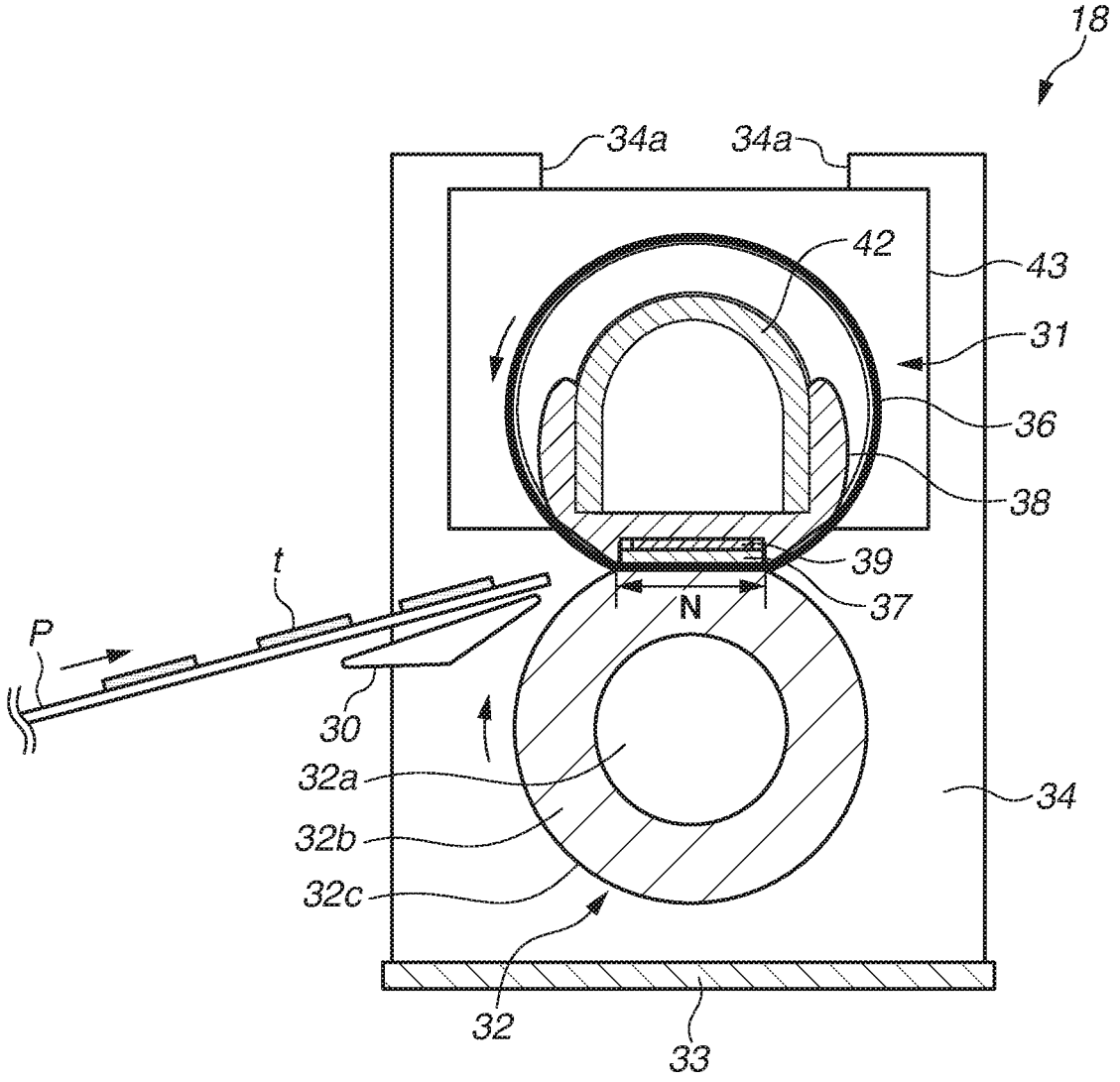
FIG. 1 is a schematic sectional view illustrating a structure of an example fixing device.
Figure 2:
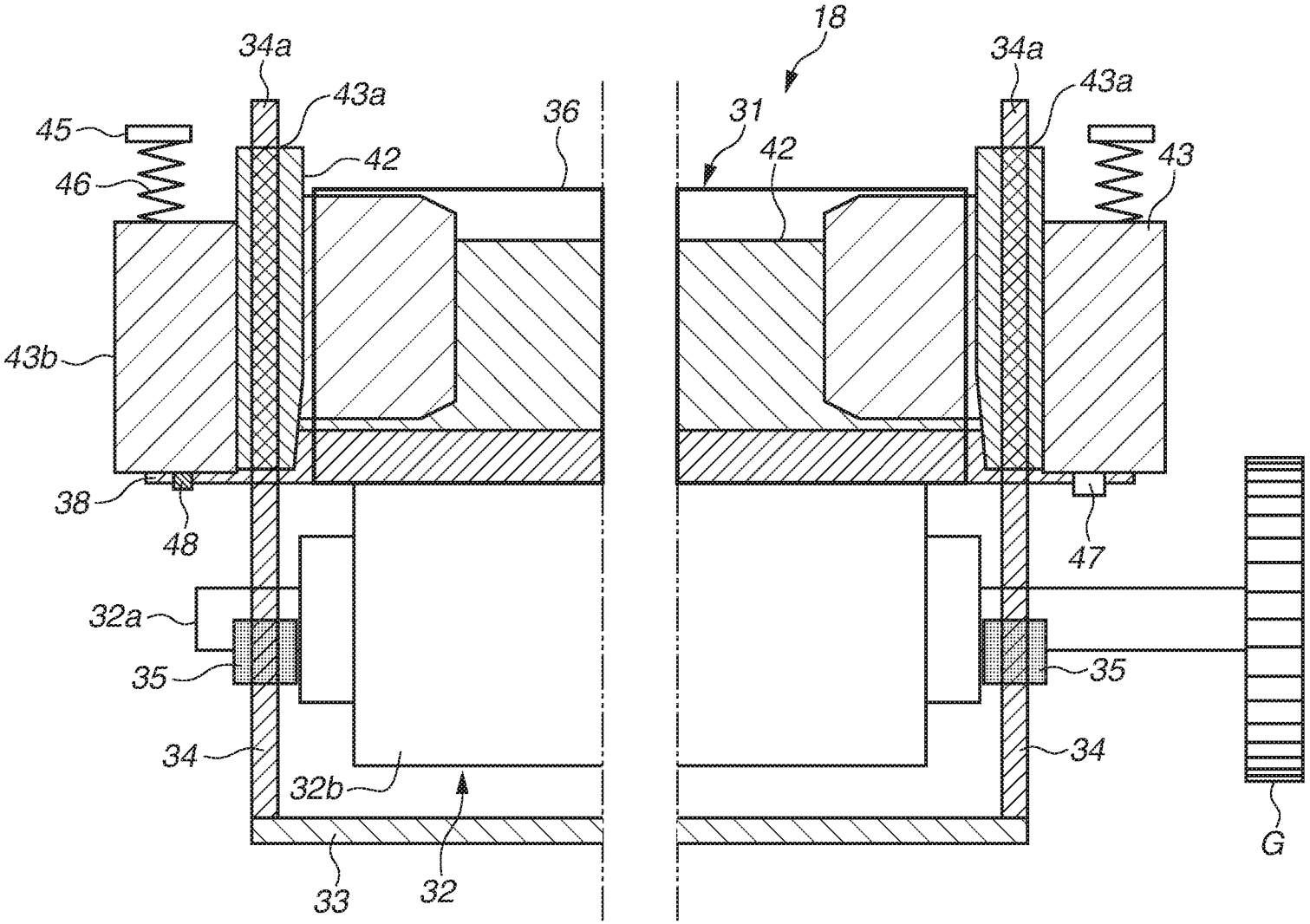
FIG. 2 is a schematic front view illustrating the structure of the fixing device.

FIG. 1 is a schematic sectional view illustrating the fixing device 18 according to the present example embodiment as viewed along the longitudinal direction of the fixing device 18. FIG. 2 is a schematic view illustrating the fixing device 18 as viewed from one end of the fixing device 18 in the transverse direction.

The fixing device 18 includes a film unit 31 including the cylindrical flexible film 36, and the pressing roller 32 serving as a pressing member. The film 36 and the pressing roller 32 are disposed substantially in parallel with each other between right and left side plates 34 of a frame 33. The fixing device 18 is configured to fix unfixed toner on a recording medium at a nip portion N, which is a contact portion between the film 36 and the pressing roller 32.

The pressing roller 32 includes a cored bar 32*a*, an elastic layer 32*b* formed on the outside of the cored bar 32*a*, and a release layer 32*c* formed on the outside of the elastic layer 32*b*. Materials used for the elastic layer 32*b* include silicone rubber, and fluororubber. Materials used for the release layer 32*c* include perfluoroalkoxy polymer (PFA), polytetrafluoroethylene (PTFE), and polyhexafluoropropylene (FEP).

The pressing roller 32 according to the present example embodiment has a structure in which the silicone rubber layer (elastic layer) 32*b* having a thickness of about 3.5 mm is formed by mold ejection on the cored bar 32*a*. The cored bar 32*a* is made of stainless steel and has an outer diameter of 11 mm. On the outside of the silicone rubber layer 32*b*, a PFA resin tube (release layer) 32*c* having a thickness of about 40 μm is formed. The outer diameter of the pressing roller 32 is 18 mm. The hardness of the pressing roller 32 is desirably in a range from 40° to 70° under a load of 9.8 N measured by an ASKER-C hardness meter in terms of, for example, securement, and endurance of the nip portion N. In the present example embodiment, the hardness of the pressing roller 32 is adjusted to 54°. The length of the elastic layer in the longitudinal direction of the pressing roller 32 is 226 mm. The pressing roller 32 is rotatably supported between the side plates 34 of the frame 33 by bearing members 35 at both ends of the cored bar 32*a* in the longitudinal direction. A drive gear G is fixed to one end of the pressing roller cored bar 32*a*. A rotary force is transmitted to the drive gear G from a drive source (not illustrated), and the pressing roller 32 is rotationally driven.

The film unit 31 illustrated in FIG. 1 includes the film 36, a plate-shaped heater 37 that contacts the inner peripheral surface of the film 36, a support member 38 that supports the heater 37, and a metal plate 39 serving as a thermally conductive member having thermal conductivity higher than that of the support member 38. The film unit 31 is fixed to the support member 38 through the metal plate 39 with a power feed connector 47 and a heater clip 48. The power feed connector 47 is provided at one end of the heater 37 in the longitudinal direction, and the heater clip 48 is provided at the other end of the heater 37 in the longitudinal direction. The film unit 31 further includes a pressing stay 42 that reinforces the support member 38, and flanges 43 that regulate a movement of the film 36 in the longitudinal direction.

The film 36 is a cylindrical flexible member including a base layer, an elastic layer formed on the outside of the base layer, and a release layer formed on the outside of the elastic layer. The film 36 according to the present example embodiment has an inner diameter of 18 mm and has a structure in which a polyimide base material having a thickness of 60 μm is used as the base layer. As the elastic layer, silicone rubber having a thickness of about 150 μm is used. As the release layer, a PFA resin tube having a thickness of 15 μm is used.

Figure 3:
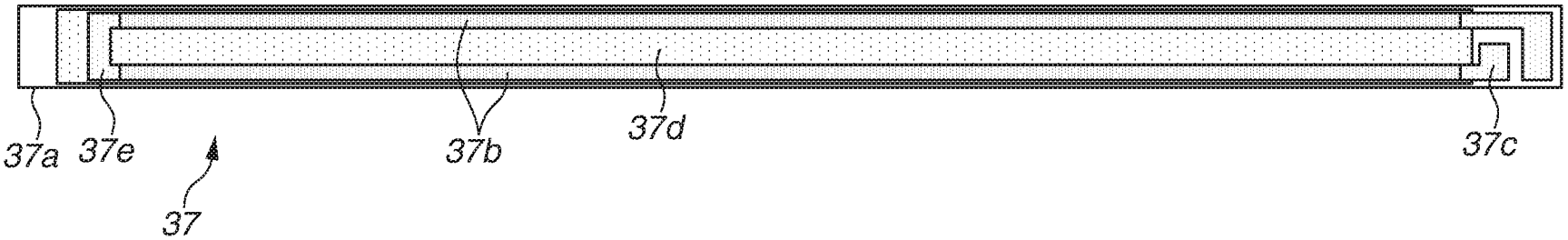
FIG. 3 illustrates an explanatory diagram of an example ceramic heater.

The heater 37 includes an insulating substrate 37*a*, heating resistor elements 37*b*, and an electrical contact portion 37*c* as illustrated in FIG. 3. The insulating substrate 37*a* is made of a ceramic material such as alumina or aluminum nitride. The heating resistor elements 37*b* are made of a material such as a silver-palladium alloy, and are formed by screen printing or the like on the substrate 37*a*. The electrical contact portion 37*c* is made of a material such as silver, and is connected to the heating resistor elements 37*b*. Power can be supplied to the heating resistor elements 37*b* through a connection of the power feed connector 47 and the electrical contact portion 37*c*, which is provided at one end of the heater 37 in the longitudinal direction.

The heater 37 includes a glass coat 37*d* on the heating resistor elements 37*b* as a protective layer for protecting the heating resistor elements 37*b*. The heater 37 is disposed along the generatrix direction of the film 36 in such a manner that one of the surfaces of the heater 37 is opposed to the pressing roller 32 through the film 36 and the other one surface, which is opposed to the one surface, is opposed to a support surface of the support member 38. The heater 37 is provided slidably with the film 36.

The substrate 37*a* of the heater 37 according to the present example embodiment has a rectangular parallelepiped shape with a longitudinal length of 270 mm, a transverse length of 5.8 mm, and a thickness of 1.0 mm. The substrate 37*a* is made of alumina. In the present example embodiment, the two heating resistor elements 37*b* are connected in series and configured to have a resistance value of 18Ω. Thus, the heating resistor elements 37*b* have such a pattern that the heating resistor elements 37*b* are connected with each other via an electrical contact portion 37*c* at one end portion in the longitudinal direction. The heating resistor element 37*b* located on an upstream side and the heating resistor element 37*b* located on a downstream side have the same shape with a longitudinal length of 222 mm and a transverse length of 0.9 mm.

As for transverse positions of the upstream and downstream heating resistor elements 37*b*, both the heating resistor elements 37*b* are disposed at positions of 0.7 mm from edges of the substrate 37*a*. The heating resistor elements 37*b* are printed at symmetrical positions with respect to a transverse center. The heater 37 is provided not only with the glass coat 37*d* but also with a heat-resistant grease applied onto the inner surface of the film 36. This improves sliding properties of the inner peripheral surface of the film 36 with the heater 37.

The support member 38 is a member that has a U-shape in cross section as illustrated in FIG. 1. The support member 38 has rigidity, heat resistance, and thermal insulation properties. In the present example embodiment, the support member 38 is formed of liquid crystal polymer. The support member 38 has two functions: a function of supporting the film 36 externally fitted with the support member 38, and a function of supporting one of the surfaces of the heater 37.

Figure 4:
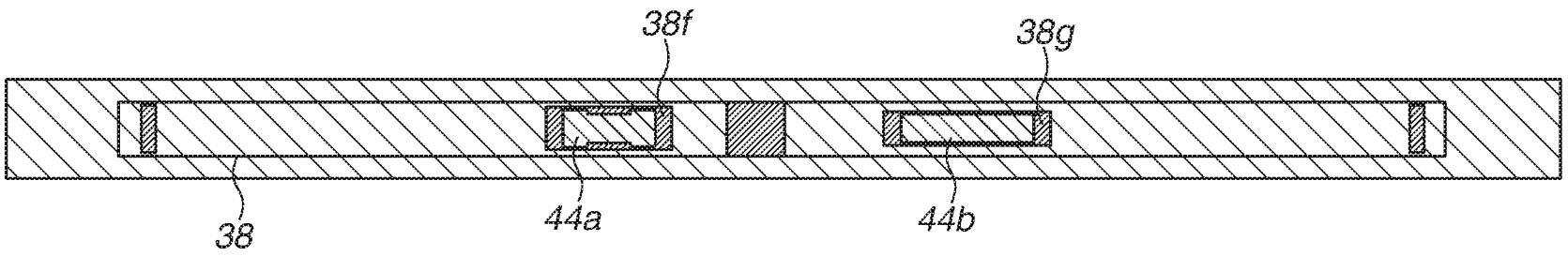
FIG. 4 illustrates an explanatory diagram of an example thermistor and a thermal fuse.

The support member 38 is provided with through-holes 38*f* and 38*g* as illustrated in FIG. 4. A thermistor 44*a* serving as a temperature detection element is disposed to contact the metal plate 39 from the through-hole 38*f*. A thermal switch 44*b* serving as a safety element is disposed to contact the metal plate 39 from the through-hole 38*g*. In other words, a temperature sensor, such as a temperature detection element and a safety element, is provided on the metal plate 39 so that heat of the heater 37 can be sensed through the metal plate 39.

The thermistor 44*a* is prepared by providing a thermistor element in a housing via ceramic paper or the like for stabilizing a contact state with the metal plate 39, and then coating the thermistor element with an insulating material such as polyimide tape. The thermal switch 44*b* is a part for detecting abnormal heat generation in the heater 37 to interrupt electrical power supply to the heater 37 when the heater 37 causes an abnormal temperature rise.

The thermal switch 44*b* is provided with a bimetal portion prepared by firmly bonding two or more types of metal or alloy with different thermal expansion coefficients and then finishing the bonded material in a plate shape. Due to abnormal high temperature generated by the heater 37, the metal portion having a large thermal expansion coefficient is bent toward the metal portion having a small thermal expansion coefficient. By using this displacement, the thermal switch 44*b* opens or closes an electrical contact, thereby interrupting a circuit for supplying electrical power to the heater 37.

The pressing stay 42 is a member that has a U-shape in cross section, and is elongated in the generatrix direction of the film 36 as illustrated in FIG. 1. The pressing stay 42 has a function of enhancing the bending rigidity of the film unit 31. The pressing stay 42 according to the present example embodiment is formed by bending a stainless steel plate with a thickness of 1.6 mm.

The right and left flanges 43 hold both ends of the pressing stay 42. Ends 34*a* of the side plates 34, which are opposed to each other on the upstream side and the downstream side in the conveyance direction, each enter vertical groove portions 43*a*, which are provided on the upstream side and the downstream side in the conveyance direction. In other words, the vertical groove portions 43*a* of the flanges 43 that are provided on the upstream side and the downstream side in the conveyance direction engage with the two opposed ends 34*a* of the side plates 34. Thus, the right and left flanges 43 are configured such that the right and left side plates 34 cause the film unit 31 to approach the pressing roller 32 or move away from the film unit 31. In the present example embodiment, a liquid crystal polymer resin is used as a material for the flanges 43.

A pressing spring 46 is disposed between a pressing arm 45 and a pressing portion 43*b* of each of the right and left flanges 43. The pressing spring 46 urges the film 36 against the pressing roller 32 through the right and left flanges 43, the pressing stay 42, the support member 38, and the heater 37 as illustrated in FIG. 2. In the present example embodiment, a press-contact force between the film 36 and the pressing roller 32 is 180 N as a total pressure. Thus, the heater 37 and the pressing roller 32 form the nip portion N (pressure contact portion) of about 6 mm against the elasticity of the pressing roller 32 through the film 36.

During the operation of the fixing device 18, a rotary force is transmitted from the drive source (not illustrated) to the drive gear G of the pressing roller 32. Thus, the pressing roller 32 is rotationally driven at a predetermined speed in a clockwise direction as illustrated in FIG. 1. In the present example embodiment, the rotational speed of the pressing roller 32 is set such that the recording medium is conveyed at a conveyance speed of 100 mm/sec. The rotational force acts on the film 36 by a frictional force acting between the pressing roller 32 and the film 36 at the nip portion N along with rotational driving of the pressing roller 32. As a result, the film 36 slides on one surface of the heater 37 while contacting the surface of the heater 37, and is driven and rotated in a counterclockwise direction around the support member 38 along with the rotation of the pressing roller 32. In this manner, the film 36 is rotated and electrical power is supplied to the heater 37, and a recording medium P is introduced in a state where the temperature of the heater 37 detected by the thermistor 44*a* reaches a target temperature. A fixing entrance guide 30 has a function of guiding the recording medium P having an unfixed toner image t formed thereon toward the nip portion N.

The recording medium P bearing the unfixed toner image t is introduced to the nip portion N, and the surface of the recording medium P that bears the toner image comes into close contact with the film 36 at the nip portion N, and then the recording medium P and the film 36 are nipped and conveyed by the nip portion N. In the conveyance process, the unfixed toner image t on the recording medium P is heated and pressed on the recording medium P by heat supplied from the film 36 heated by the heater 37. Thus, the unfixed toner image t is fused and fixed onto the recording medium P.

(Thermally Conductive Member)

Figure 5A:
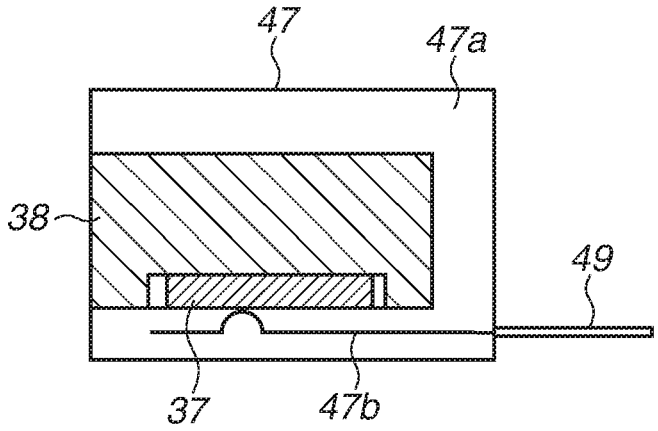
FIGS. 5A and 5B are sectional views each illustrating an example method for holding a heater and a metal plate according to related art.
Figure 5B:
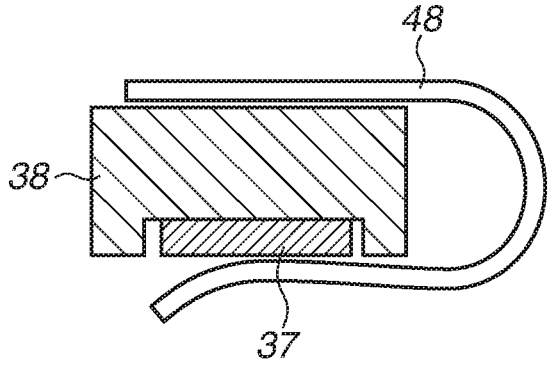

Next, the metal plate 39 serving as a thermally conductive member of related art and a method for holding the metal plate 39 will be described. FIGS. 5A and 5B are sectional views each illustrating an end of each of the heater 37 and the support member 38. The metal plate 39 is disposed between the support member 38 and the heater 37 as illustrated in FIGS. 1 and 2. One of the power feed connector 47 and the heater clip 48, each of which serves as a holding member, is provided at one end of the heater 37 in the longitudinal direction, and the other one of the power feed connector 47 and the heater clip 48 is provided at the other end of the heater 37 in the longitudinal direction as illustrated in FIGS. 5A and 5B. Thus, the heater 37 is supported by the support member 38 in such a manner that a central portion of the heater 37 in the longitudinal direction contacts the support member 38 via the metal plate 39. Further, ends of the heater 37 in the longitudinal direction directly contacting the support member 38 are supported by the support member 38.

The power feed connector 47 is formed of a housing portion 47*a*, which is made of a recessed resin material, and a contact terminal 47*b*. The power feed connector 47 nips and holds the heater 37 and the support member 38. Further, the contact terminal 47*b* contacts the electrical contact portion 37*c* of the heater 37, and thus the power feed connector 47 is electrically connected to the heater 37. In the present example embodiment, the power feed connector 47 is used as a heater holding member. However, the power feed connector 47 may be divided into separate members, i.e., a member having the function of feeding power to the heater 37, and a member serving as the heater holding member. The contact terminal 47*b* is connected to a wire 49. The wire 49 is connected to an alternating current (AC) power supply and a triac which are not illustrated.

The heater clip 48 formed of a metal plate bent in a U-shape holds, as a holding member, the heater 37 owing to its spring properties in a state where an end of the heater 37 in the longitudinal direction contacts the support member 38. The end of the heater 37 that is pressed by the heater clip 48 is configured to allow the movement of the heater 37 in the longitudinal direction. With this structure, expansion or contraction of the heater 37 is allowed during thermal expansion of the heater 37, and thus an unnecessary stress from acting on the heater 37 is prevented.

Figure 6A:
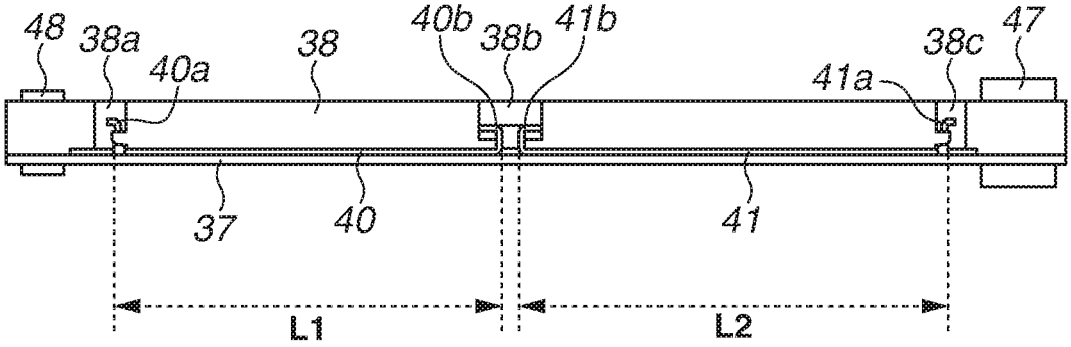
FIGS. 6A, 6B and 6C are explanatory diagrams each illustrating an example layout of a heater holding member and metal plates.
Figure 6B:
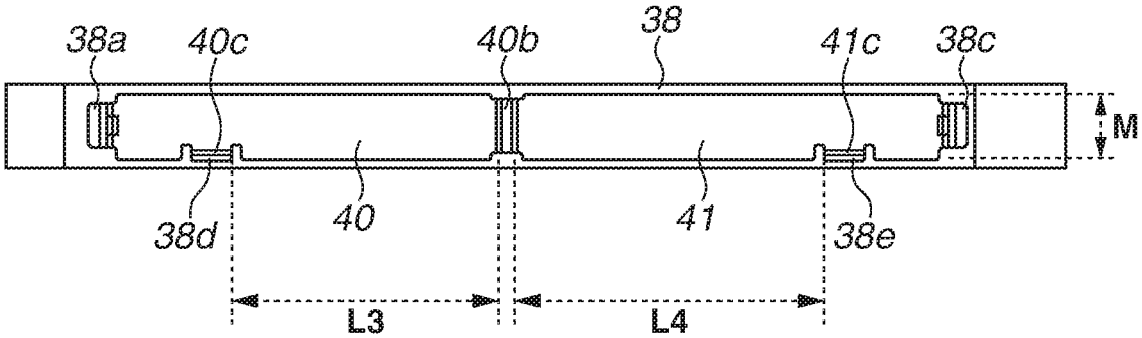
Figure 6C:
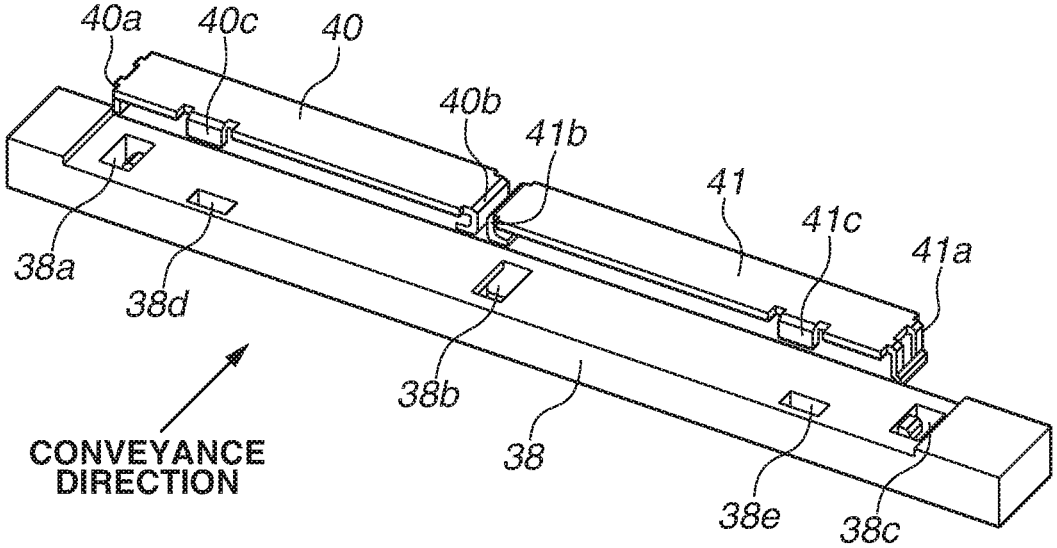

A structure using two metal plates 40 and 41 according to the related art as the metal plate 39 will be described with reference to FIGS. 6A to 6C. In the present example embodiment, an aluminum plate having a constant thickness of 0.3 mm (hereinafter referred to simply as an aluminum plate) is used as each of the metal plates 40 and 41. A width M in the conveyance direction of each of contact portions of the aluminum plates 40 and 41 in contact with the heater 37 is 7 mm. A longitudinal length L1 of the aluminum plate 40 is 102 mm, and a longitudinal length L2 of the aluminum plate 41 is 115 mm. The aluminum plates 40 and 41 are placed on the support member 38 with a gap formed therebetween in the longitudinal direction. The aluminum plate 40 includes bent portions 40*a* and 40*b* at both ends in the longitudinal direction. The bent portions 40*a* and 40*b* are respectively inserted into mounting holes 38*a* and 38*b* of the support member 38. Similarly, the aluminum plate 41 includes bent portions 41*a* and 41*b* at both ends in the longitudinal direction, and the bent portions 41*a* and 41*b* are respectively inserted into mounting holes 38*c* and 38*b* of the support member 38. The bent portions 40*a* is inserted into the mounting hole 38*a*, the bent portions 40*b* and 41*b* are inserted into the mounting hole 38*b*, and the bent portion 41*a* is inserted into the mounting hole 38*c*. Further, a downstream end in the conveyance direction of each of the bent portions 40*a*, 40*b*, 41*a*, and 41*b* is brought into contact with an inner wall of the corresponding one of the mounting holes 38*a* to 38*c*, thereby the aluminum plates 40 and 41 are positioned in the conveyance direction. On the other hand, the mounting holes 38*a* to 38*c* have a width greater than that of the bent portions 40*a*, 40*b*, 41*a*, and 41*b* of the aluminum plates 40 and 41, and thereby allowing stretching of the aluminum plates 40 and 41 in the longitudinal direction due to thermal expansion.

The aluminum plate 40 includes a bent portion 40*c* at an end in the conveyance direction, and the bent portion 40*c* is inserted into a mounting hole 38*d* of the support member 38. Similarly, the aluminum plate 41 includes a bent portion 41*c* at an end in the conveyance direction, and the bent portion 41*c* is inserted into a mounting hole 38*e* of the support member 38. The bent portions 40*c* and 41*c* are inserted into the mounting holes 38*d* and 38*e*, respectively. Further, one end in the longitudinal direction of each of the bent portions 40*c* and 41*c* is brought into contact with an inner wall of the corresponding one of the mounting holes 38*d* and 38*e*, and thereby the aluminum plates 40 and 41 are positioned in the longitudinal direction. On the other hand, in view of manufacturing tolerance, the mounting holes 38*d* and 38*e* have a width greater than that of the bent portions 40*c* and 41*c* of the aluminum plates 40 and 41, and thereby allowing the movement in the conveyance direction.

Figure 7A:
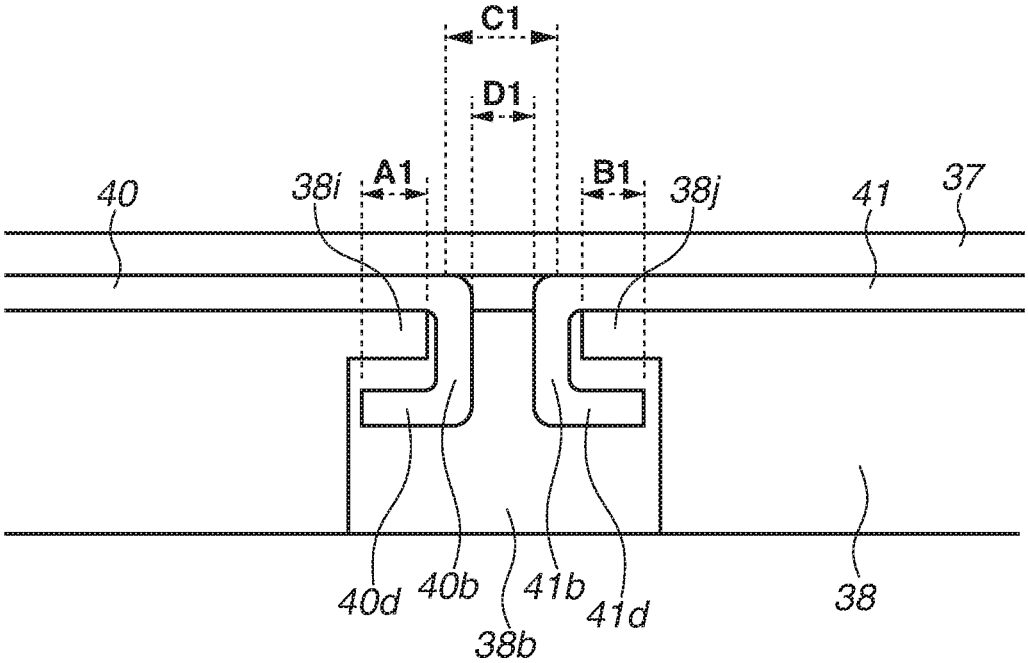
FIGS. 7A and 7B are enlarged views each illustrating a gap between the metal plates according to the related art.
Figure 7B:
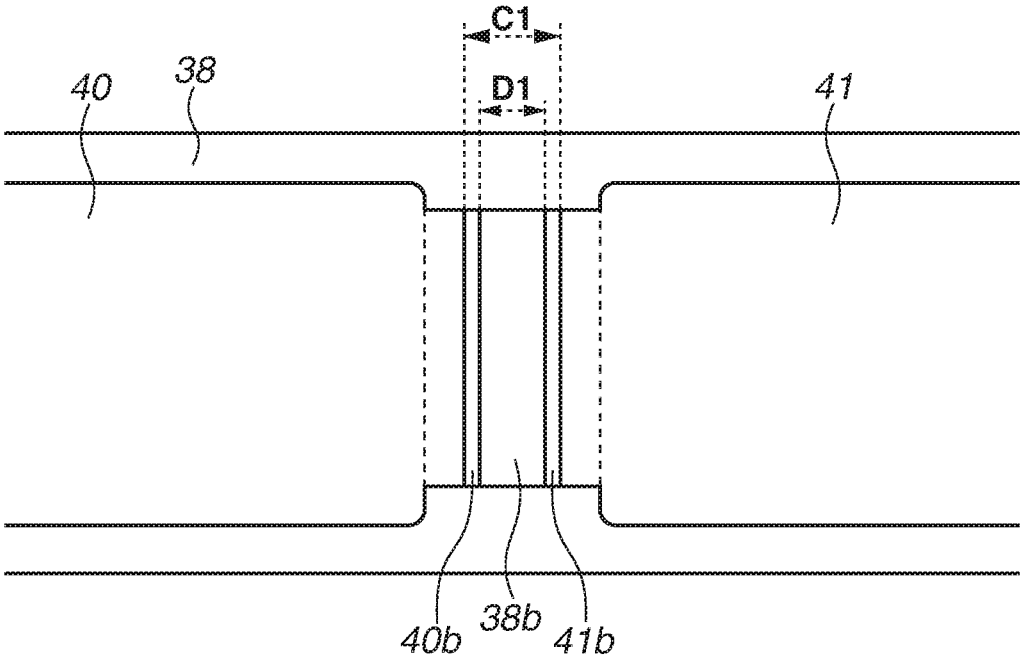

Next, a gap located at a central portion in the longitudinal direction when the aluminum plates 40 and 41 according to the related art thermally expand will be described with reference to FIGS. 7A and 7B and FIGS. 8A and 8B. FIG. 7A is a sectional view illustrating the central portion in the longitudinal direction before thermal expansion in a state where the aluminum plates 40 and 41 are provided on the support member 38 below the heater 37. FIG. 7B illustrates the support member 38 as viewed from a mounting surface of the heater 37 in a state where the heater 37 is omitted. In other words, FIG. 7A is a sectional view of FIG. 7B in which the illustration of the heater 37 is omitted. The aluminum plates 40 and 41 include hooking portions 40*d* and 41*d*, respectively. The hooking portions 40*d* and 41*d* engage with protrusions 38*i* and 38*j*, respectively, which are provided on the support member 38 and protrude toward the inside of the mounting hole 38*b* in the longitudinal direction. The hooking portions 40*d* and 41*d* and the protrusions 38*i* and 38*j* overlap each other in the longitudinal direction by the amounts corresponding to a width A1 and a width B1, respectively, as viewed from the mounting surface of the heater 37. Thus, the hooking portions 40*d* and 41*d* regulate the movement of the aluminum plates 40 and 41 in a direction away from the support member 38 toward the mounting surface of the heater 37. A gap with a width D1 is provided between the aluminum plates 40 and 41, so that the aluminum plates 40 and 41 are prevented from contacting each other and being deformed due to thermal expansion. A width C1 corresponds to a portion where the heater 37 and the aluminum plates 40 and 41 are not in contact with each other in the longitudinal direction at the gap of the central portion.

Figure 8A:
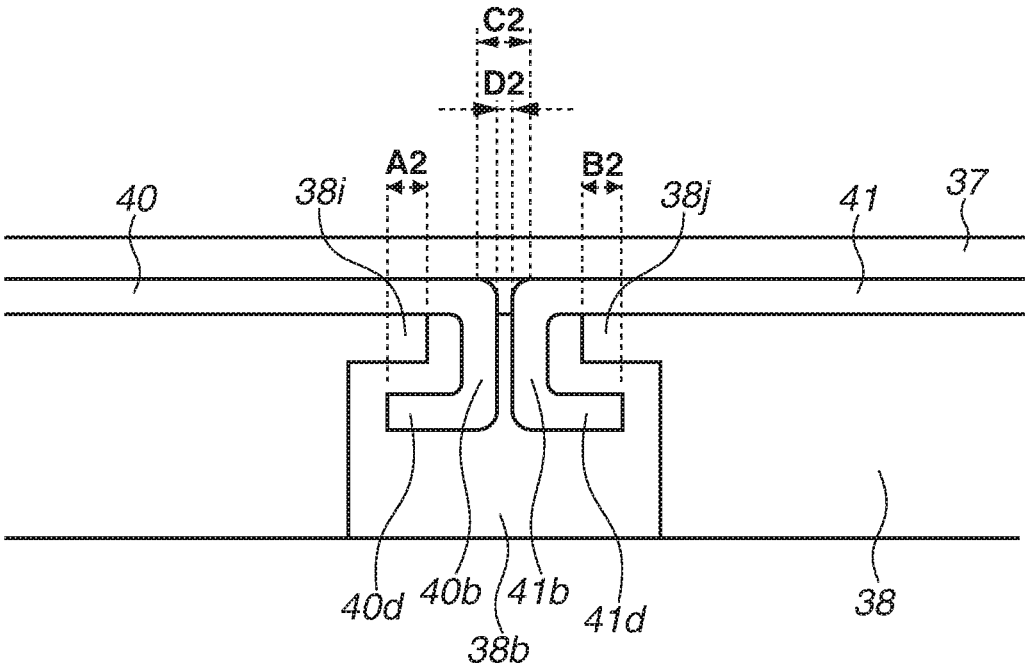
FIGS. 8A and 8B are enlarged views each illustrating the gap between the metal plates during thermal expansion according to the related art.
Figure 8B:
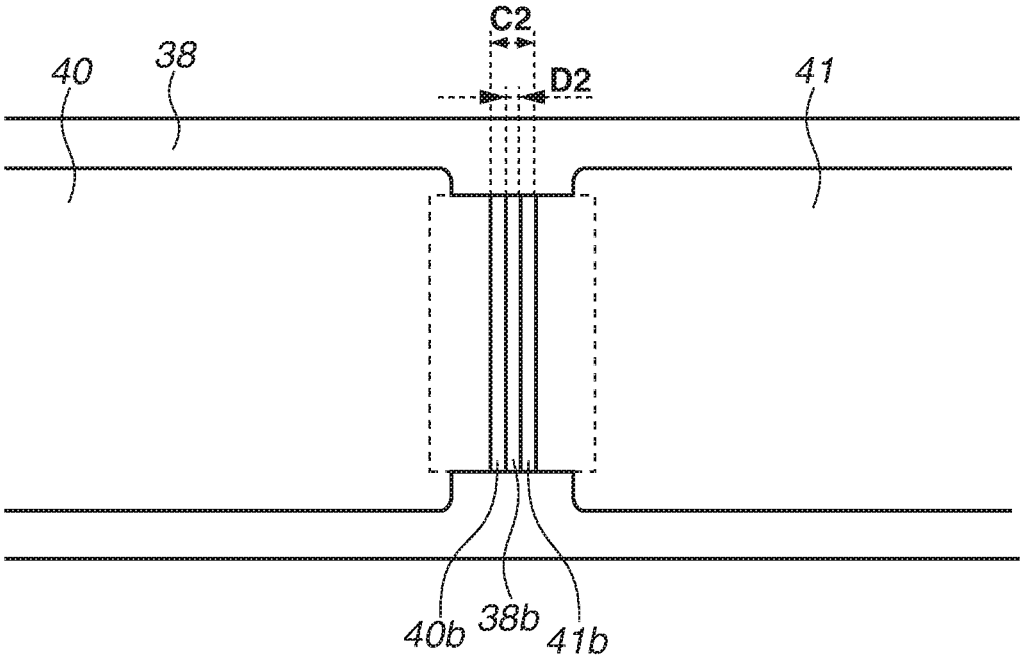

FIG. 8A is a sectional view illustrating the central portion in a state where the aluminum plates 40 and 41 provided on the support member 38 thermally expand, in a state where the heater 37 is omitted. FIG. 8B illustrates the central portion as viewed from the mounting surface of the heater 37. When the aluminum plates 40 and 41 thermally expand, a width C2 of a portion where the heater 37 and the aluminum plates 40 and 41 are not in contact with each other in the central portion is smaller than the width C1 before thermal expansion. Similarly, a width D2 of the gap at the central portion is smaller than the width D1 of the gap before thermal expansion. This is because the aluminum plates 40 and 41, which are positioned in the longitudinal direction with respect to the support member 38, stretch toward the central portion from the bent portions 40*c* and 41*c* due to thermal expansion of portions having lengths L3 and L4, respectively. The respective lengths L3 and L4 are the lengths between the bent portions 40*c* and 41*c* and the central portion. Even when thermal expansion occurs, the gap with the width D2 prevents the aluminum plates 40 and 41 from contacting each other and being deformed. However, the width C2 of the portion where the heater 37 and the aluminum plates 40 and 41 are not in contact with each other causes a local temperature rise at the central portion of the heater 37, which may cause a defective image such as hot offset corresponding to the width C1. In this case, overlapping widths A2 and B2 of the hooking portions 40*d* and 41*d* of the aluminum plates 40 and 41 with the protrusions 38*i* and 38*j* of the support member 38 are smaller than the overlapping widths A1 and B1 before thermal expansion occurs. However, the aluminum plates 40 and 41 maintain the function of regulating the movement in a direction away from the support member 38 toward the mounting surface of the heater 37.

Figure 9A:
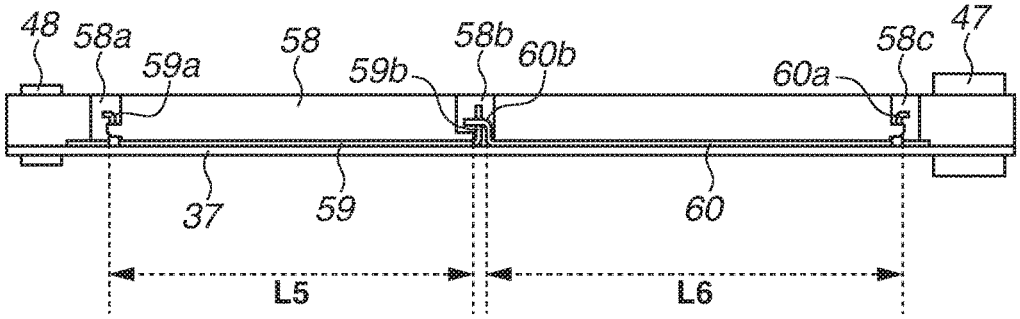
FIGS. 9A to 9D are schematic diagrams each illustrating a method for holding a heater and metal plates according to a first example embodiment.
Figure 9B:
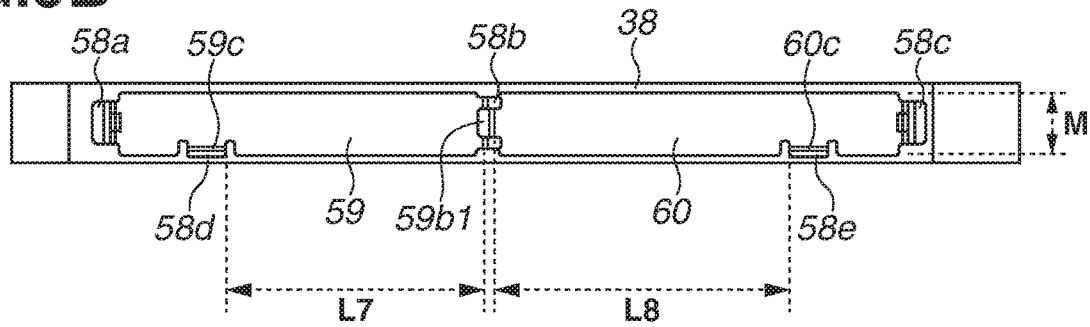
Figure 9C:
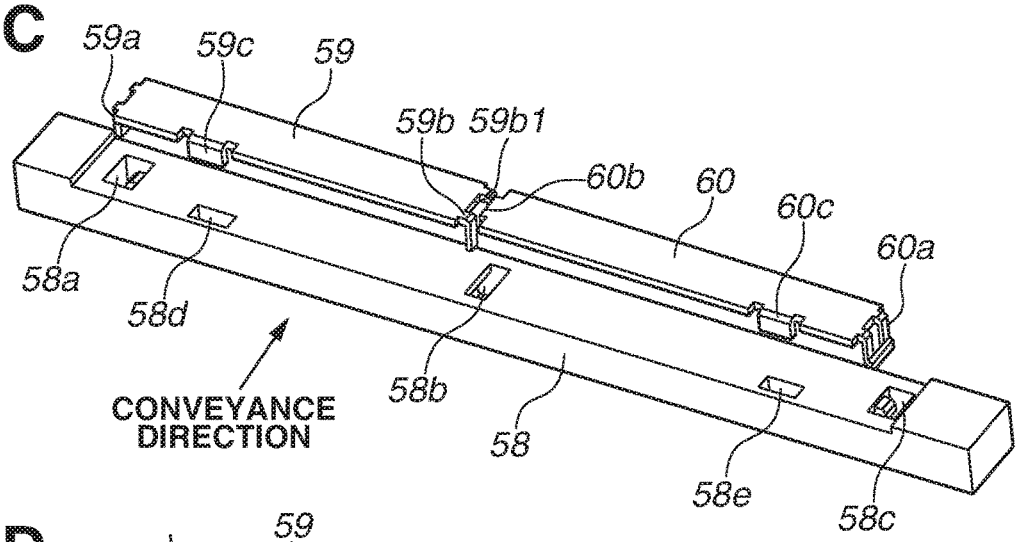
Figure 9D:
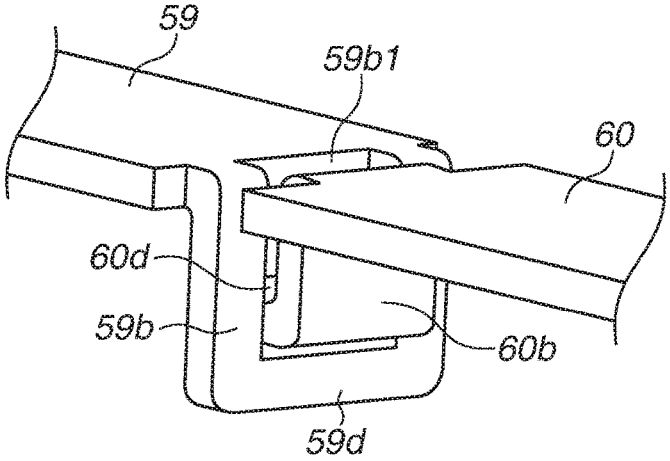

Next, aluminum plates 59 and 60 each serving as the metal plate 39 according to the present example embodiment and a method for holding the aluminum plates 59 and 60 by a support member 58 serving as the support member 38 according to the present example embodiment will be described with reference to FIGS. 9A to 9D. FIG. 9A is a sectional view taken along a plane extending in the longitudinal direction. FIG. 9B illustrates a state where the aluminum plates 59 and 60 are provided on the support member 58 in a state where the heater 37 is omitted as viewed from the heater 37. FIG. 9C is a perspective view illustrating engagement portions of the aluminum plates 59 and 60. FIG. 9D is a perspective view illustrating a state where the aluminum plates 59 and 60 engage with each other at a central portion in the longitudinal direction. In FIG. 9A, the illustration of the thermistor 44*a* and the thermal switch 44*b* is omitted.

The aluminum plates 59 and 60 and engagement portions of the aluminum plates 59 and 60 provided on the support member 58 will be described with reference to FIGS. 9A to 9D. In the present example embodiment, the aluminum plates 59 and 60 each having a constant thickness of 0.3 mm are used. The width M in the conveyance direction of each of contact portions of the aluminum plates 59 and 60 in contact with the heater 37 is 7 mm. A longitudinal length L5 of the aluminum plate 59 is 101 mm, and a longitudinal length L6 of the aluminum plate 60 is 114 mm. The aluminum plates 59 and 60 are placed on the support member 38 with a gap formed therebetween in the longitudinal direction. The aluminum plate 59 includes bent portions 59*a* and 59*b* at both ends in the longitudinal direction. The bent portions 59*a* and 59*b* are respectively inserted into mounting holes 58*a* and 58*b* of the support member 58. The bent portion 59*b* is provided with a hole 59*b*1 at a central portion in the conveyance direction. The aluminum plate 60 includes bent portions 60*a* and 60*b* at both ends in the longitudinal direction. The bent portion 60*a* (entering portion) is inserted into a mounting hole 58*c* of the support member 58. The bent portion 60*b* is inserted into the hole 59*b*1 provided on the bent portion 59*b* of the aluminum plate 59. The bent portion 59*a*, 59*b*, and 60*a* are inserted into the mounting holes 58*a*, 58*b*, and 58*c*, respectively. Further, a downstream end of each of the bent portion 59*a*, 59*b*, and 60*a* in the conveyance direction is brought into contact with an inner wall of the mounting holes 58*a*, 58*b*, and 58*c*, respectively, so that the aluminum plates 59 and 60 are positioned in the conveyance direction. The bent portion 60*b* is inserted into the hole 59*b*1. Further, a downstream end of the bent portion 60*b* in the conveyance direction is brought into contact with an inner wall of the hole 59*b*1, so that the aluminum plate 60 is positioned in the conveyance direction with respect to the aluminum plate 59. On the other hand, the mounting holes 58*a* to 58*c* have a width greater than that of the bent portions 59*a*, 59*b*, 60*a*, and 60*b* of the aluminum plates 59 and 60, and thereby allowing stretching of the aluminum plates 59 and 60 in the longitudinal direction due to thermal expansion.

The aluminum plate 59 includes a bent portion 59*c* at an end in the conveyance direction. The bent portion 59*c* is inserted into a mounting hole 58*d* of the support member 58. Similarly, the aluminum plate 60 includes a bent portion 60*c* at an end in the conveyance direction. The bent portion 60*c* is inserted into a mounting hole 58*e* of the support member 58. The bent portions 59*c* and 60*c* are inserted into the mounting holes 58*d* and 58*e*, respectively. Further, a longitudinal end of each of the bent portions 59*c* and 60*c* is brought into contact with an inner wall of the corresponding one of the mounting holes 58*d* and 58*e*, so that the aluminum plates 59 and 60 are positioned in the longitudinal direction. On the other hand, the mounting holes 58*d* and 58*e* have, in view of manufacturing tolerance, a width greater than that of the bent portions 59*c* and 60*c* of the aluminum plates 59 and 60, and thereby allowing the movement in the conveyance direction.

Figure 10A:
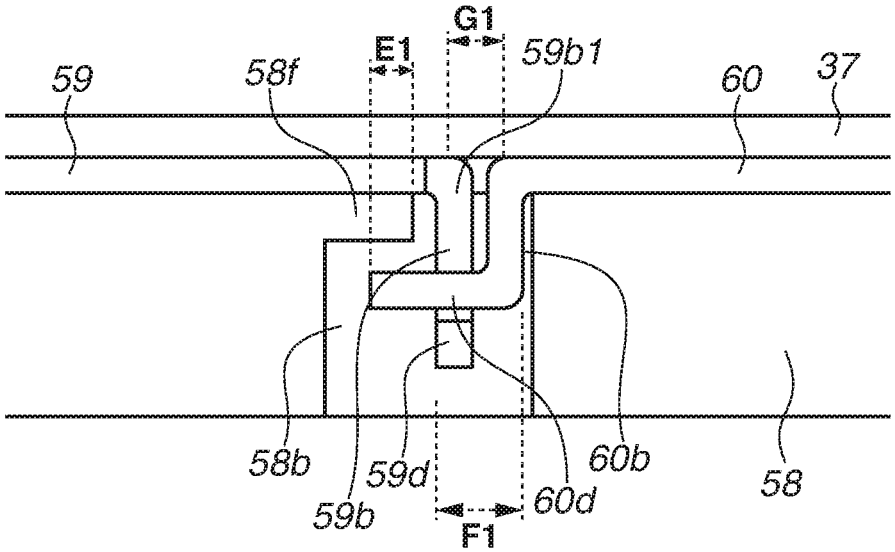
FIGS. 10A and 10B are enlarged views each illustrating a gap between the metal plates according to the first example embodiment.
Figure 10B:
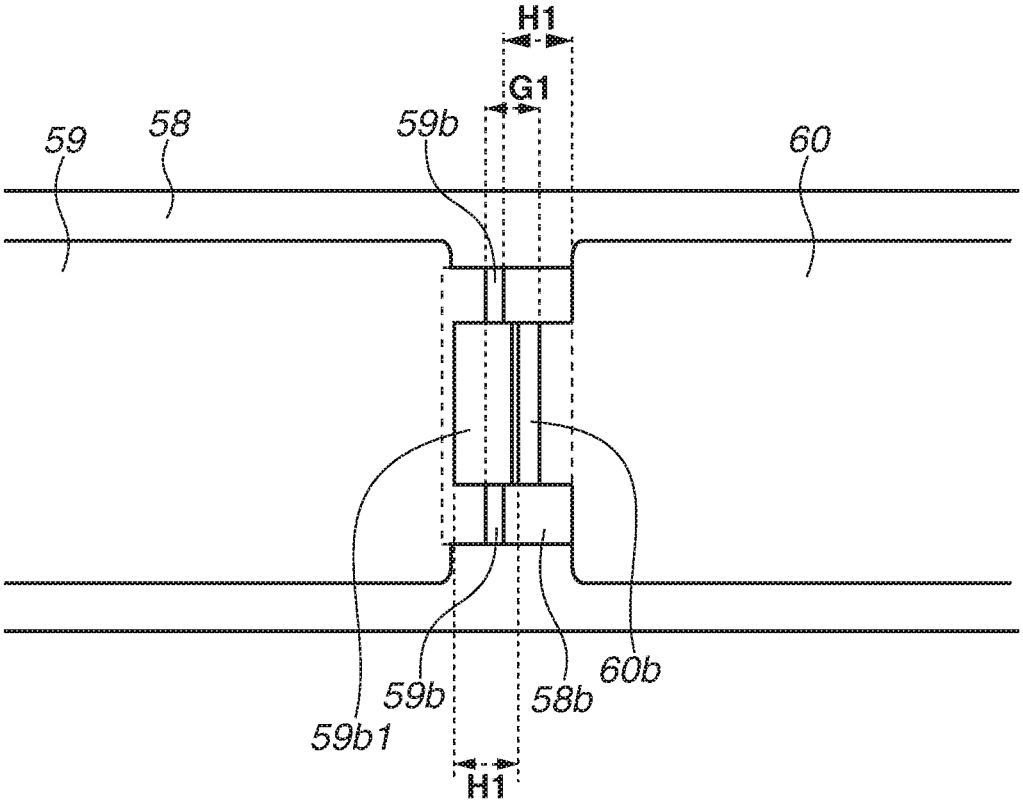

Next, a gap located at a central portion in the longitudinal direction when the thermally conductive members (aluminum plates 59 and 60) according to the present example embodiment thermally expand will be described with reference to FIGS. 10A and 10B and FIGS. 11A and 11B. FIG. 10A is a sectional view illustrating the central portion in the longitudinal direction before thermal expansion in a state where the aluminum plates 59 and 60 are provided on the support member 58 below the heater 37. FIG. 10B illustrates the support member 58 as viewed from the mounting surface of the heater 37 in a state where the heater 37 is omitted.

The bent portion 60*c* of the aluminum plate 60 has a crank shape, and includes a portion extending in a direction in which the portion enters the mounting hole 58*b* of the support member 58, and a hooking portion 60*d*, which leads to the portion and extends toward the outside (toward the aluminum plate 59) in the longitudinal direction. The hooking portion 60*d* overlaps a hooking portion 58*f*, which is provided on the support member 58 and protrudes toward the inside of the mounting hole 58*b* in the longitudinal direction, by the amount corresponding to a width E1 in the longitudinal direction as viewed from the mounting surface of the heater 37. With this structure, the hooking portion 60*d* regulates the movement of the aluminum plate 60 in a direction away from the support member 58 toward the mounting surface of the heater 37. On the other hand, the bent portion 59*b* of the aluminum plate 59 includes a hooking portion 59*d* that extends in a direction away from the heater 37 and is located at a position closer to an end than the hole 59*b*1. The hooking portion 59*d* overlaps the hooking portion 60*d* by the amount corresponding to a width F1 in the longitudinal direction as viewed from the mounting surface of the heater 37. The hooking portion 60*d* is configured to engage with the hooking portion 59*d*, so that the movement of the aluminum plate 59 is regulated in a direction away from the aluminum plate 60 toward the mounting surface of the heater 37. Further, a gap with a width H1 is provided between the aluminum plates 59 and 60 in the longitudinal direction, and thus the aluminum plates 59 and 60 are prevented from contacting each other and being deformed due to thermal expansion. A width G1 corresponds to a portion where the heater 37 and the aluminum plates 59 and 60 are not in contact with each other in the longitudinal direction at the gap of the central portion.

Figure 11A:
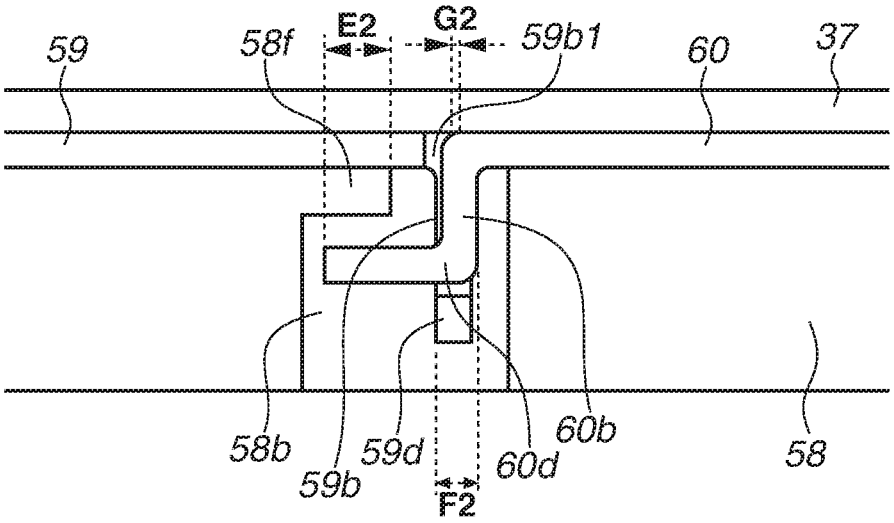
FIGS. 11A and 11B are enlarged views each illustrating the gap between the metal plates during thermal expansion according to the first example embodiment.
Figure 11B:
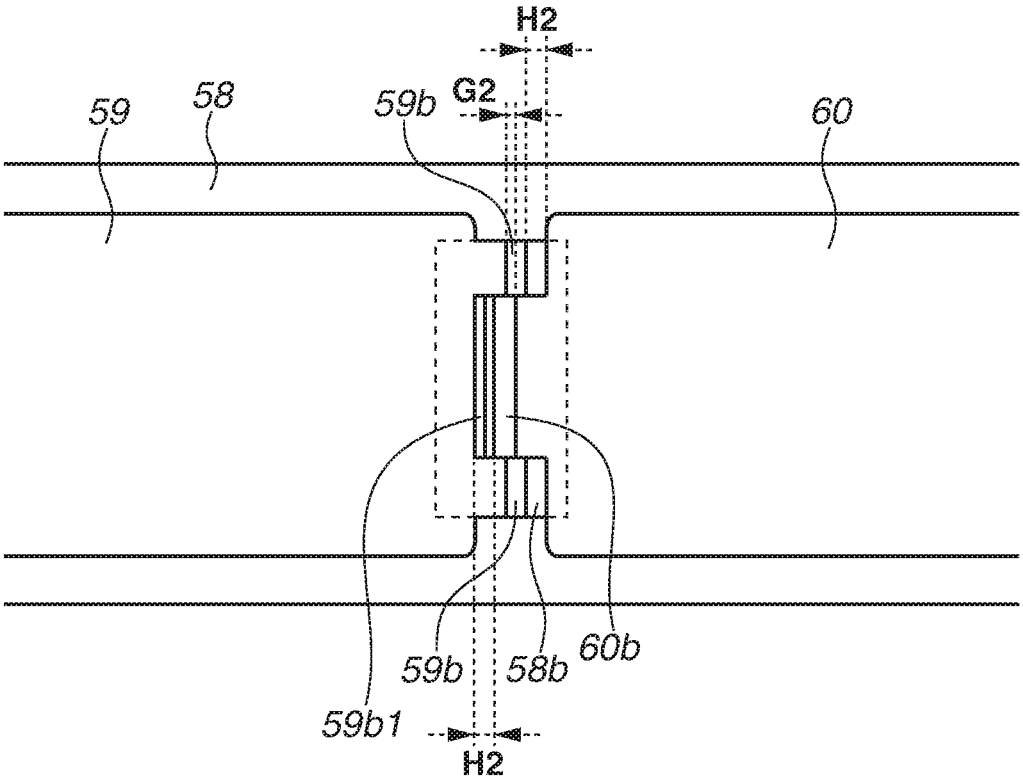

FIG. 11A is a sectional view illustrating the central portion in the longitudinal direction in a state where the aluminum plates 59 and 60 provided on the support member 58 thermally expand, in a state where the heater 37 is omitted. FIG. 11B illustrates the central portion as viewed from the mounting surface of the heater 37.

When the aluminum plates 59 and 60 thermally expand, the aluminum plates 59 and 60 stretch toward the central portion from the bent portions 59*c* and 60*c* due to thermal expansion of portions having lengths L7 and L8, respectively, of the aluminum plates 59 and 60. Accordingly, as in the related art, a width G2 of a portion, which is located at the central portion in the longitudinal direction and at which the aluminum plates 59 and 60 and the heater 37 are not in contact with each other, becomes smaller than the width G1 before thermal expansion. Similarly, a width H2 of a gap between the aluminum plates 59 and 60, which is located at the central portion in the longitudinal direction, is smaller than the width H1 of the gap before thermal expansion occurs. However, as in the related art, even when thermal expansion occurs, the gap (width H2) prevents the aluminum plates 59 and 60 from contacting each other and being deformed.

In the structure according to the present example embodiment, the width G1 of the area where the heater 37 and the aluminum plates 59 and 60 are not in contact with each other can be set to be smaller than the width C1 of the area where the heater 37 and the aluminum plates 40 and 41 are not in contact with each other according to the related art. The width C1 according to the related art is required to be set to a width greater than or equal to the total width of a width increased due to thermal expansion of the aluminum plates 40 and 41, a width of a bent portion of the bent portion 40*b* leading to the heater contact surface of the aluminum plate 40, and a width of a bent portion of the bent portion 41*b* leading to the heater contact surface of the aluminum plate 41. Each bent portion is a portion where the plate material is bent. In other words, the bent portion of the bent portion 40*b* corresponds to an area where the aluminum plate 40 is opposed to the heater 37 and is not in contact with the heater 37, and the bent portion of the bent portion 41*b* corresponds to an area where the aluminum plate 41 is opposed to the heater 37 and is not in contact with the heater 37. However, the width G1 according to the present example embodiment is required to be set to a width greater than or equal to the total width of a width increased due to thermal expansion of the aluminum plates 59 and 60 and a width of a bent portion of the bent portion 60*b* leading to the heater contact surface of the aluminum plate 60. That is, in the structure according to the present example embodiment, the width G1 can be reliably reduced by the amount corresponding to a single bent portion as compared with the width C1 according to the related art. Thus, in the structure according to the present example embodiment, the interval between the aluminum plates 59 and 60 can be reduced as compared with the related art. In addition, the effect of leveling the temperature in a wide area of the heater 37 by the aluminum plates 59 and 60 can be obtained, and the occurrence of a defective image can be prevented.

An overlapping width E2 of the hooking portion 60*d* of the aluminum plate 60 with the protrusion (hooking portion 58*f*) of the support member 58 in the longitudinal direction is greater than the overlapping width E1 before thermal expansion. Accordingly, the function of regulating the movement of the aluminum plate 60 in a direction away from the support member 58 toward the mounting surface of the heater 37 is maintained. An overlapping width F2 of the hooking portion 59*d* of the aluminum plate 59 with the hooking portion 60*d* of the aluminum plate 60 in the longitudinal direction is smaller than the overlapping width F1 before thermal expansion occurs. However, the function of regulating the movement of the aluminum plate 59 in a direction away from the aluminum plate 60 toward the mounting surface of the heater 37 is maintained. That is, as in the related art, even when thermal expansion occurs, the movement of the aluminum plates 59 and 60 in a direction away from the support member 58 toward the mounting surface of the heater 37 is regulated.

In the present example embodiment as described above, the gap for preventing the aluminum plates from contacting each other and being deformed is secured, and the function of regulating the movement of the aluminum plates 59 and 60 in a direction away from the support member 58 toward the mounting surface of the heater 37 is secured, even when thermal expansion occurs as in the related art. In addition, in the present example embodiment, the width G1 of the portion where the heater 37 and the aluminum plates 59 and 60 are not in contact with each other can be reduced, and the function of leveling the temperature in a wider area of the heater 37 by the aluminum plates 59 and 60 can be obtained. Furthermore, a temperature rise can be suppressed, so that the occurrence of a defective image can be prevented.

In the structure according to the present example embodiment as described above, the thermally conductive members adjacent to each other are disposed on the support member so that the thermally conductive members can engage with each other, and one of the thermally conductive members regulates the movement of the other one of the thermally conductive members in a direction away from the support member. Consequently, it is possible to prevent the gap between the thermally conductive members from being increased, while preventing deformation of the thermally conductive members due to the contact between the adjacent thermally conductive members. It is also possible to suppress a local temperature rise in the heating member between the thermally conductive members to thereby prevent the occurrence of a defective image.

The structure of the aluminum plates 59 and 60 is not limited to the structure according to the example embodiment described above, and instead can be appropriately changed by, for example, changing a structure of the contact portions of the aluminum plates 59 and 60 with the heater 37. For example, the bent portion 59*b* may be provided with the hole 59*b*1 formed in an area including a bent portion, and the bent portion 60*b* may have a structure in which a portion that enters the hole 59*b*1 in the longitudinal direction while being in contact with the heater 37, a portion that extends in a direction away from the heater 37, and the hooking portion 60*d* are sequentially formed. With this structure, the width G1 of the portion where the heater 37 and the aluminum plates 59 and 60 are not in contact with each other can be reduced, and the effect of leveling the temperature in a wider area of the heater 37 by the aluminum plates 59 and 60 can be obtained. In addition, a temperature rise is suppressed, and thus the occurrence of a defective image can be prevented.

A second example embodiment according to the present disclosure will be described below. An outline of a fixing device according to the second example embodiment is the same as that of the first example embodiment, and thus the description thereof is omitted and only the features of the second example embodiment will be described.

Figure 12A:
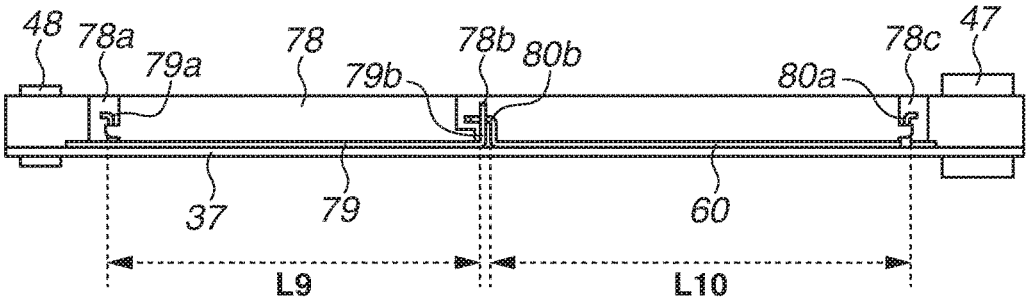
FIGS. 12A to 12D are schematic diagrams each illustrating a method for holding a heater and metal plates according to a second example embodiment.
Figure 12B:
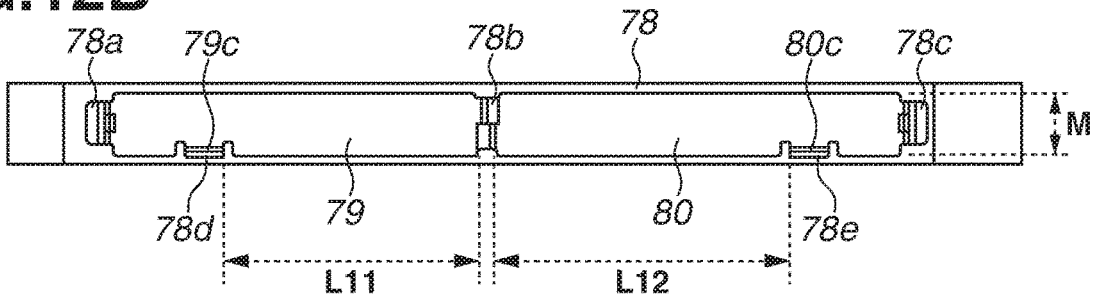
Figure 12C:
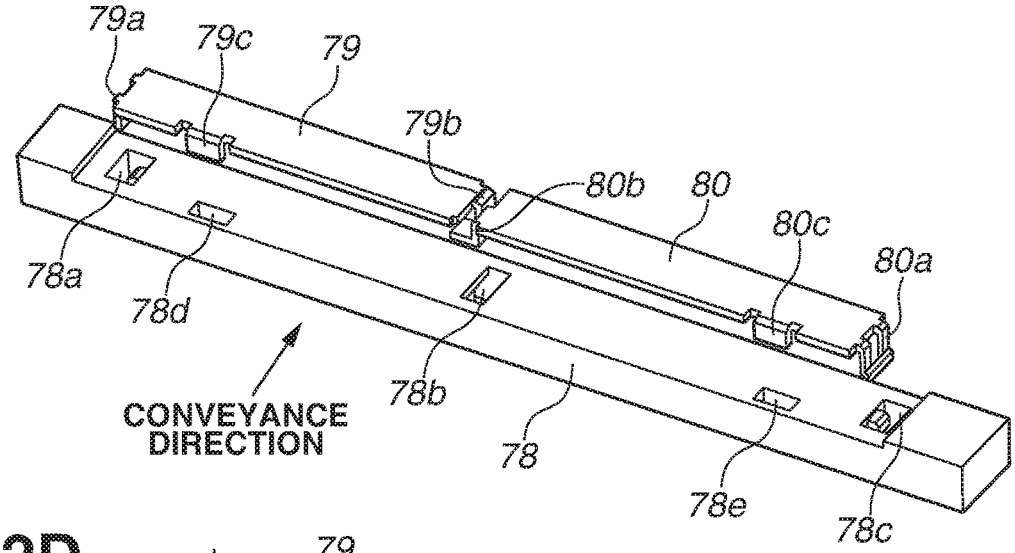
Figure 12D:
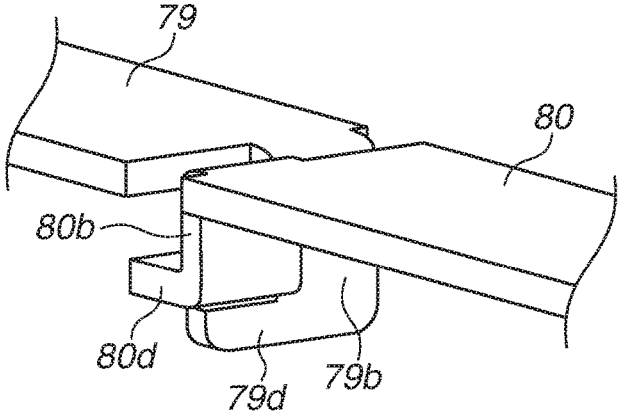

Aluminum plates 79 and 80 each serving as the metal plate 39 according to the present example embodiment and a method for holding the aluminum plates 79 and 80 by a support member 78 serving as the support member 58 according to the present example embodiment will be described with reference to FIGS. 12A to 12D. FIG. 12A is a sectional view illustrating the aluminum plates 79 and 80 in the longitudinal direction. FIG. 12B illustrates a state where the aluminum plates 79 and 80 are provided on the support member 78 as viewed from the heater 37 in a state where the heater 37 is omitted. FIG. 12C is a perspective view illustrating engagement portions of the aluminum plates 79 and 80. FIG. 12D is a perspective view illustrating a state where the aluminum plates 79 and 80 engage with each other at a central portion in the longitudinal direction. In FIG. 12A, the illustration of the thermistor 44*a* and the thermal switch 44*b* is omitted.

The aluminum plates 79 and 80 and engagement portions of the aluminum plates 79 and 80 provided on the support member 78 will be described with reference to FIGS. 12A to 12D. In the present example embodiment, the aluminum plates 79 and 80 each having a constant thickness of 0.3 mm are used. The width M in the conveyance direction of each of the contact portions of the aluminum plates 79 and 80 in contact with the heater 37 is 7 mm. A longitudinal length L9 of the aluminum plate 79 is 101 mm, and a longitudinal length L10 of the aluminum plate 80 is 114 mm. The aluminum plates 79 and 80 are placed with a gap formed therebetween at a central portion.

The aluminum plate 79 includes bent portions 79*a* and 79*b* at both ends in the longitudinal direction. The bent portions 79*a* and 79*b* are respectively inserted into mounting holes 78*a* and 78*b* of the support member 78. In the present example embodiment, the aluminum plate 79 has a structure in which a cutaway portion is provided at an upstream portion in the conveyance direction and the bent portion 79*b* extending from a downstream portion in the conveyance direction is provided, at one end opposed to the aluminum plate 80 in the longitudinal direction. The bent portions 79*a* and 79*b* are inserted into the mounting holes 78*a* and 78*b*, respectively. Further, a downstream end of each of the bent portions 79*a* and 79*b* in the conveyance direction is brought into contact with an inner wall of the mounting holes 78*a* and 78*b*, respectively, so that the aluminum plate 79 is positioned in the conveyance direction. On the other hand, the mounting holes 78*a* and 78*b* have a width greater than that of the bent portions 79*a* and 79*b* of the aluminum plate 79, and thereby allowing stretching of the aluminum plate 79 in the longitudinal direction due to thermal expansion.

The aluminum plate 80 includes bent portions 80*a* and 80*b* at both ends in the longitudinal direction. The bent portions 80*a* and 80*b* are respectively inserted into mounting holes 78*b* and 78*c* of the support member 78. In the present example embodiment, the aluminum plate 80 has a structure in which a cutaway portion is provided at a downstream portion in the conveyance direction and the bent portion 80*b* extending from an upstream portion in the conveyance direction is provided, at one end opposed to the aluminum plate 79 in the longitudinal direction. The bent portion 80*a* is inserted into the mounting hole 78*c* and a downstream end of the bent portion 80*a* in the conveyance direction is brought into contact with an inner wall of the mounting hole 78*c*, so that the aluminum plate 79 is positioned in the conveyance direction. The bent portion 80*b* is inserted into the mounting hole 78*b* and a downstream end of the bent portion 80*b* in the conveyance direction is brought into contact with an upstream end of the bent portion 79*b* in the conveyance direction, so that the aluminum plate 80 is positioned in the conveyance direction with respect to the aluminum plate 79. On the other hand, the mounting holes 78*b* and 78*c* have a width greater than that of the bent portions 79*a*, 79*b*, 80*a*, and 80*b* of the aluminum plates 79 and 80, and thereby allowing stretching of the aluminum plates 79 and 80 in the longitudinal direction due to thermal expansion.

The aluminum plate 79 includes a bent portion 79*c* at an end in the conveyance direction. The bent portion 79*c* is inserted into a mounting hole 78*d* of the support member 78. Similarly, the aluminum plate 80 includes a bent portion 80*c* at an end in the conveyance direction, and the bent portion 80*c* is inserted into a mounting hole 78*e* of the support member 78. The bent portions 79*c* and 80*c* are inserted into the mounting holes 78*d* and 78*e*, respectively. Further, a longitudinal end of each of the bent portions 79*c* and 80*c* is brought into contact with an inner wall of the corresponding one of the mounting holes 78*d* and 78*e*, so that the aluminum plates 79 and 80 are positioned in the longitudinal direction. On the other hand, in view of manufacturing tolerance, the mounting holes 78*d* and 78*e* have a width greater than that of the bent portions 79*c* and 80*c* of the aluminum plates 79 and 80, and thereby allowing the movement in the conveyance direction.

Figure 13A:
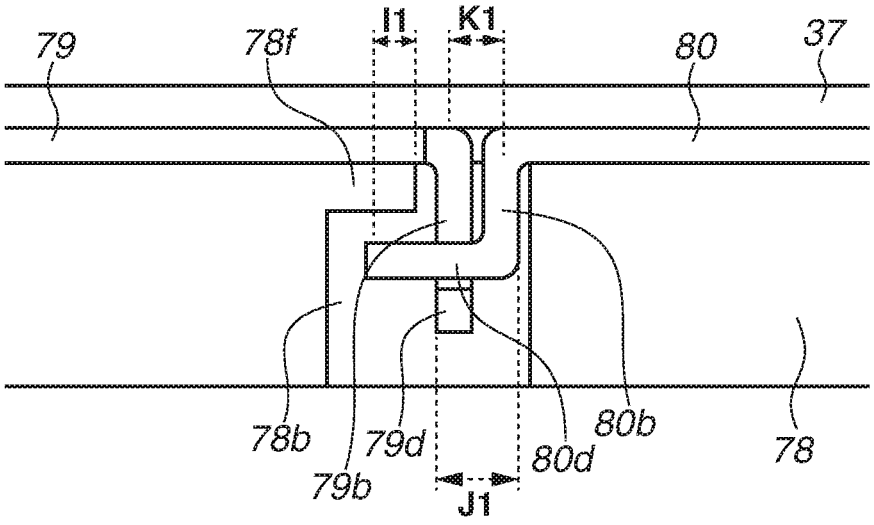
FIGS. 13A and 13B are enlarged views each illustrating a gap between the metal plates according to the second example embodiment.
Figure 13B:
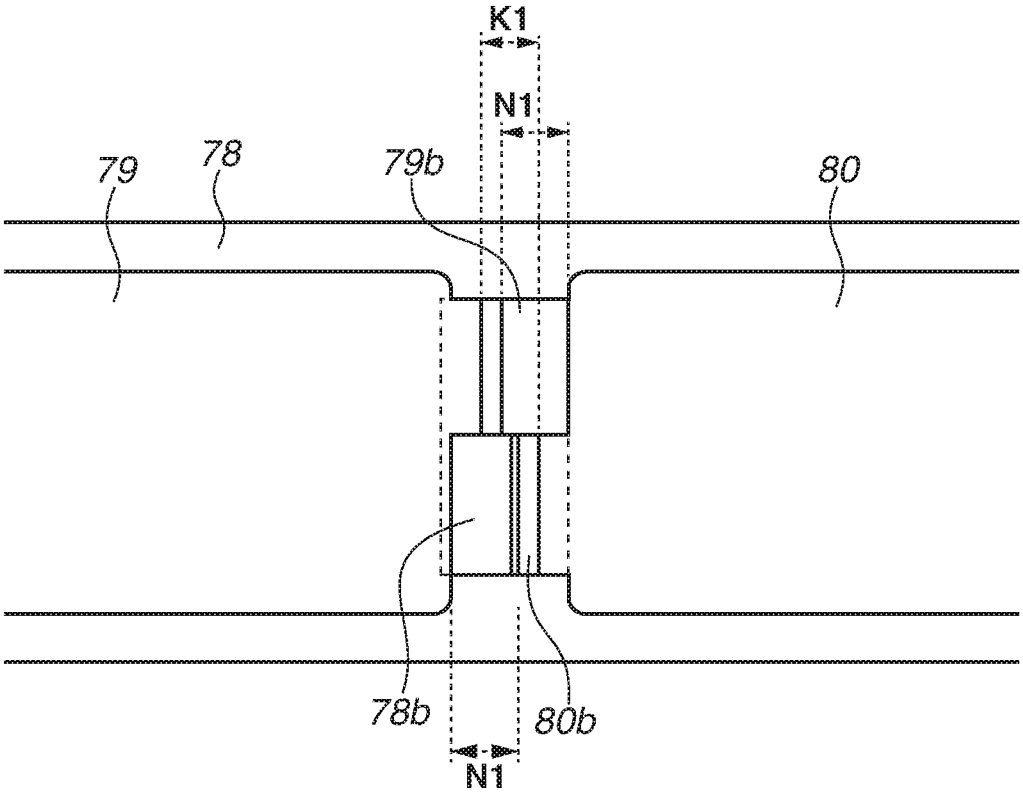

Next, a gap located at a central portion in the longitudinal direction when the aluminum plates 79 and 80 according to the present example embodiment thermally expand will be described with reference to FIGS. 13A and 13B and FIGS. 14A and 14B. FIG. 13A is a sectional view illustrating the central portion in the longitudinal direction before thermal expansion in a state where the aluminum plates 79 and 80 are provided on the support member 78 below the heater 37. FIG. 13B illustrates the support member 78 as viewed from the mounting surface of the heater 37 in a state where the heater 37 is omitted.

The bent portion 80*b* of the aluminum plate 80 has a crank shape, and includes a portion extending in a direction in which the portion enters the mounting hole 78*b* of the support member 78, and a hooking portion 80*d* that leads to the portion and extends toward the outside (toward the aluminum plate 79) in the longitudinal direction. The hooking portion 80*d* engages with a hooking portion 78*f*, which is provided on the support member 78 and protrudes toward the inside of the mounting hole 78*b* in the longitudinal direction, and overlaps with the hooking portion 78*f* by the amount corresponding to a width I1 in the longitudinal direction as viewed from the mounting surface of the heater 37. With this structure, the hooking portion 78*f* regulates the movement of the aluminum plate 80 in a direction away from the support member 78 toward the mounting surface of the heater 37. On the other hand, the bent portion 79*b* of the aluminum plate 79 includes a hooking portion 79*d* extending to the upstream side in the conveyance direction from a portion farther from the hooking portion 80*d* in a direction away from the heater 37. The hooking portion 79*d* is configured to overlap the hooking portion 80*d* as viewed from the mounting surface of the heater 37 by the amount corresponding to a width J1 in the longitudinal direction. Thus, the hooking portion 80*d* is configured to engage with the hooking portion 79*d*, so that the movement of the aluminum plate 79 is regulated in a direction away from the aluminum plate 80 toward the mounting surface of the heater 37. A gap with a width N1 is provided between the aluminum plates 79 and 80 in the longitudinal direction, so that the aluminum plates 79 and 80 are prevented from contacting each other and being deformed due to thermal expansion. A width K1 corresponds to a portion where the heater 37 and the aluminum plates 79 and 80 are not in contact with each other in the longitudinal direction, at the gap of the central portion.

Figure 14A:
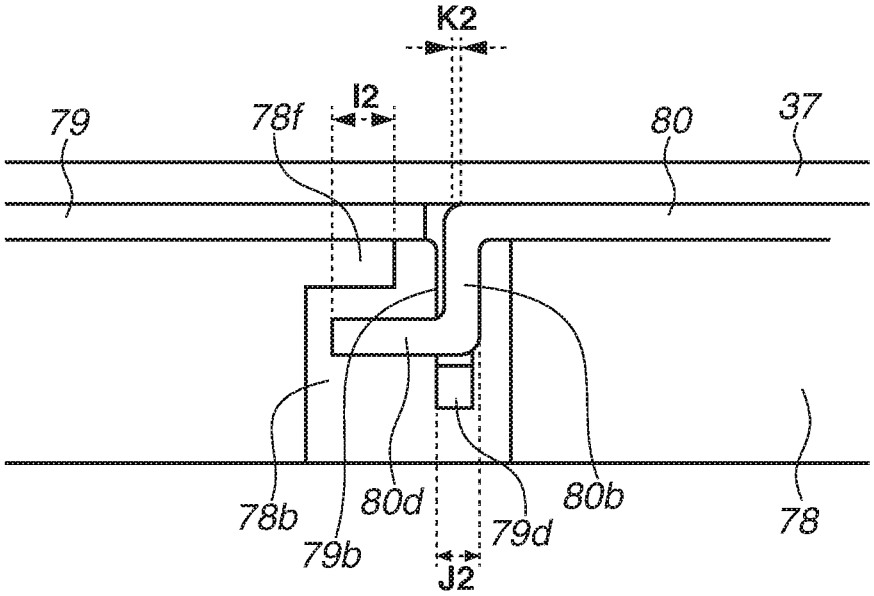
FIGS. 14A and 14B are enlarged views each illustrating the gap between the metal plates during thermal expansion of a fixing device according to the second example embodiment.
Figure 14B:
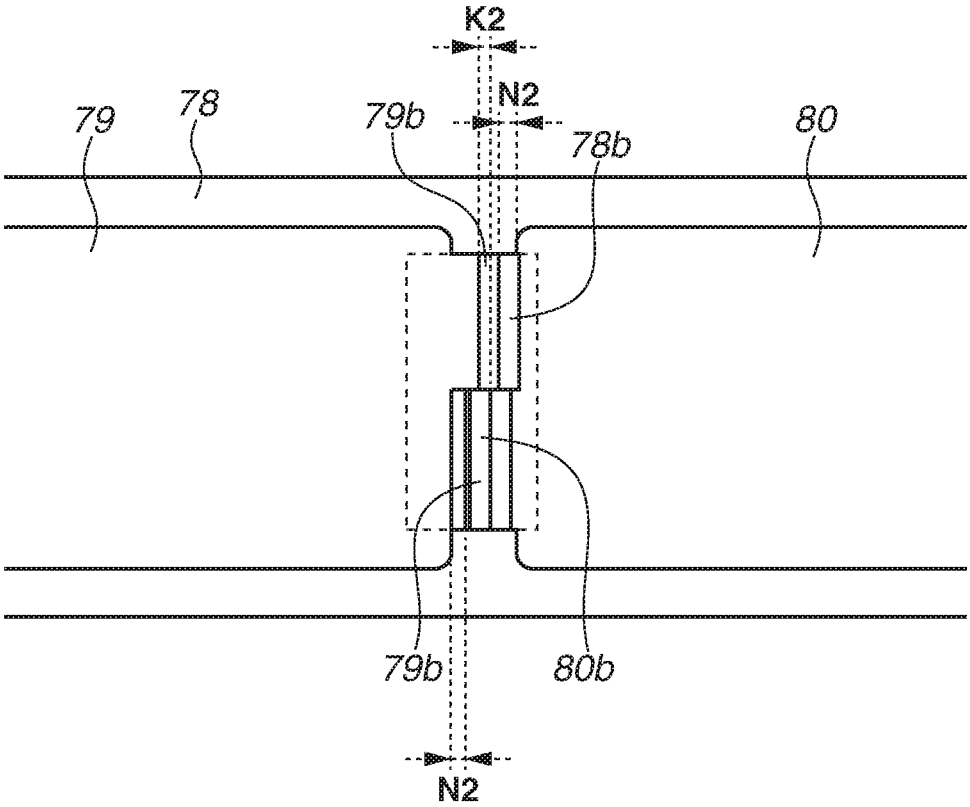

FIG. 14A is a sectional view illustrating the central portion in the longitudinal direction in a state where the aluminum plates 79 and 80 provided on the support member 78 thermally expand, in a state where the heater 37 is omitted. FIG. 14B illustrates the central portion as viewed from the mounting surface of the heater 37.

When the aluminum plates 79 and 80 thermally expand, the aluminum plates 79 and 80 stretch toward the central portion from the bent portions 79*c* and 80*c* due to thermal expansion of portions having lengths L11 and L12, respectively, of the aluminum plates 79 and 80. Accordingly, as in the related art, a width K2 of a portion that is located at the central portion in the longitudinal direction and at which the heater 37 and the aluminum plates 79 and 80 are not in contact with each other is smaller than the width K1 before thermal expansion occurs. Similarly, a width N2 of a gap between the aluminum plates 79 and 80 that is located at the central portion in the longitudinal direction is smaller than the width N1 of the gap before thermal expansion occurs. However, as in the related art, the gap N2 prevents the aluminum plates 79 and 80 from contacting each other and being deformed even when thermal expansion occurs. On the other hand, in the structure according to the present example embodiment, the width K1 of the area where the heater 37 and the aluminum plates 79 and 80 are not in contact with each other can be reduced as compared with the width C1 of the area where the heater 37 and the aluminum plates 40 and 41 are not in contact with each other according to the related art. The width C1 according to the related art is required to be set to a width greater than or equal to the total width of a width increased due to thermal expansion of the aluminum plates 40 and 41, a width of a bent portion of the bent portion 40*b* leading to the heater contact surface of the aluminum plate 40, and a width of a bent portion of the bent portion 41*b* leading to the heater contact surface of the aluminum plate 41. Each bent portion is a portion where the plate material is bent. In other words, the bent portion of the bent portion 40*b* corresponds to an area where the aluminum plate 40 is opposed to the heater 37 and is not in contact with the heater 37, and the bent portion of the bent portion 41*b* corresponds to an area where the aluminum plate 41 is opposed to the heater 37 and is not in contact with the heater 37. However, the width K1 according to the present example embodiment may be greater than or equal to the total width of a width increased due to thermal expansion of the aluminum plates 79 and 80, and a width of a bent portion of the bent portion 79*b* leading to the heater contact surface of the aluminum plate 79 or a width of a bent portion of the bent portion 80*b* leading to the heater contact surface of the aluminum plate 80. That is, in the structure according to the present example embodiment, the width K1 can be reliably reduced by the amount corresponding to a single bent portion as compared with the width C according to the related art. Consequently, in the structure according to the present example embodiment, the interval between the aluminum plates 79 and 80 can be reduced as compared with the related art, and the effect of leveling the temperature in a wider area of the heater 37 by using the aluminum plates 79 and 80 can be obtained. In addition, a temperature rise is suppressed, and thus the occurrence of a defective image can be prevented.

An overlapping width 12 of the support member 78 of the hooking portion 80*d* of the aluminum plate 80 with the protrusion (hooking portion 78*f*) of the support member 78 in the longitudinal direction is greater than the overlapping width I1 before thermal expansion occurs. Accordingly, the function of regulating the movement of the aluminum plate 80 in a direction away from the support member 78 toward the mounting surface of the heater 37 is maintained. Further, an overlapping width J2 of the hooking portion 79*d* of the aluminum plate 79 with the hooking portion 80*d* of the aluminum plate 80 in the longitudinal direction is smaller than the overlapping width J1 before thermal expansion occurs. However, the function of regulating the movement of the aluminum plate 79 in a direction away from the aluminum plate 80 toward the mounting surface of the heater 37 is maintained. That is, as in the related art, the movement of the aluminum plates 79 and 80 in a direction away from the support member 78 toward the mounting surface of the heater 37 is regulated even when thermal expansion occurs.

As described above in the present example embodiment, even when thermal expansion occurs, the gap for preventing the aluminum plates from contacting each other and being deformed is secured and the function of regulating the movement of the aluminum plates 79 and 80 in a direction away from the support member 78 toward the mounting surface of the heater 37 is secured, as in the related art. In addition, in the present example embodiment, it is possible to reduce the width K1 of the portion where the heater 37 and the aluminum plates 79 and 80 are not in contact with each other, and it is also possible to obtain the effect of leveling the temperature in a wide area of the heater 37 by using the aluminum plates 79 and 80, and thus the occurrence of a defective image can be prevented.

As described above, in the structure according to the example embodiments, the thermally conductive members adjacent to each other are disposed on the support member so that the thermally conductive members can engage with each other, and one of the thermally conductive members regulates the movement of the other one of the thermally conductive members in a direction away from the support member. Consequently, it is possible to prevent the gap between the thermally conductive members from being increased, while preventing deformation of the thermally conductive members due to the contact between the adjacent thermally conductive members. Therefore, it is possible to suppress a local temperature rise in the heating member between the thermally conductive members and prevent the occurrence of a defective image.

The structure of the aluminum plates 79 and 80 is not limited to the structure according to the example embodiments described above, but instead can be appropriately changed by, for example, changing the contact portions of the aluminum plates 59 and 60 with the heater 37. For example, the aluminum plates 79 and 80 may have a structure in which a cutaway portion extending in the longitudinal direction is provided, and a contact surface of the bent portion 79*b* that contacts the heater 37 and a contact surface of the bent portion 80*b* that contacts the heater 37 may be arranged side by side in the conveyance direction. With this structure, the width N1 of the portion where the heater 37 and the aluminum plates 79 and 80 are not in contact with each other can be reduced to "0". Accordingly, the effect of leveling the temperature in a wider area of the heater 37 by the aluminum plates 79 and 80 can be obtained, and a temperature rise is suppressed. Thus, the occurrence of a defective image is prevented.

While the present disclosure has been described with reference to example embodiments, it is to be understood that the disclosure is not limited to the disclosed example embodiments. The scope of the following claims is to be accorded the broadest interpretation so as to encompass all such modifications and equivalent structures and functions.

This application claims the benefit of Japanese Patent Application No. 2019-093232, filed May 16, 2019, which is hereby incorporated by reference herein in its entirety.

What is claimed is:

1. A fixing device for fixing a toner image formed on a recording medium to the recording medium at a fixing nip, comprising:

a cylindrical film;

a heater configured to heat the toner image, the heater is provided in an inner space of the film, the heater is elongated along a generatrix direction of the film;

a support member configured to support the heater over a longitudinal direction of the heater, the support member is provided in the inner space of the film;

a pressure roller contacting an outer peripheral surface of the film and configured to form the fixing nip in cooperation with the heater through the film, a first thermally conductive member provided between the heater and the support member, the first thermally conductive member being brought into contact with the heater and the support member; and a second thermally conductive member provided between the heater and the support member, the second thermally conductive member being brought into contact with the heater and the support member, and provided at a position different from a position of the first thermally conductive member in the longitudinal direction of the heater, wherein the first thermally conductive member includes a first portion having a hole extending in a direction away from the heater, at an end opposed to the second thermally conductive member in a longitudinal direction, wherein the second thermally conductive member includes a second portion and a hooking portion, the second portion extending in the direction away from the heater, the hooking portion being configured to enter the hole of the first thermally conductive member, at an end opposed to the first thermally conductive member in the longitudinal direction, and wherein the support member includes a hole for inserting the first portion of the first thermally conductive member and the second portion and the hooking portion of the second thermally conductive member.

2. The fixing device according to claim 1, wherein a movement of the second thermally conductive member in a direction away from the support member is regulated by an engagement of the hooking portion of the second thermally conductive member with the support member, and wherein a movement of the first thermally conductive member in a direction away from the support member is regulated by an engagement of the hole of the first thermally conductive member with the second thermally conductive member.

3. The fixing device according to claim 1, wherein the first and second thermally conductive members are made of metal.

4. The fixing device according to claim 3, wherein the first portion of the first thermally conductive member is a part obtained by bending the first thermally conductive member, and the second portion and the hooking portion of the second thermally conductive member is a part obtained by bending the second thermally conductive member, and wherein when the first thermally conductive member and the second thermally conductive member are expanded in the direction of approaching each other by heat, the overlap width of the first thermally conductive member and the hooking portion of the second thermally conductive member in the longitudinal direction extend.

5. The fixing device according to claim 1, wherein the first thermally conductive member includes a first positioning portion for positioning the first thermally conductive member with respect to the support member in the longitudinal direction at a position different from a position of the first portion of the first thermally conductive member, and wherein the second thermally conductive member includes a second positioning portion for positioning the second thermally conductive member with respect to the support member in the longitudinal direction at a position different from a position of the second portion of the second thermally conductive member.

6. A fixing device for fixing a toner image formed on a recording medium to the recording medium at a fixing nip, comprising:

a cylindrical film;

a heater configured to heat the toner image, the heater is provided in an inner space of the film, the heater is elongated along a generatrix direction of the film;

a support member configured to support the heater over a longitudinal direction of the heater, the support member is provided in the inner space of the film;

a pressure roller contacting an outer peripheral surface of the film and configured to form the fixing nip in cooperation with the heater through the film, a first thermally conductive member provided between the heater and the support member, the first thermally conductive member is brought into contact with the heater and the support member; and a second thermally conductive member provided between the heater and the support member, the second thermally conductive member is brought into contact with the heater and the support member, and is provided at a position different from a position of the first thermally conductive member in the longitudinal direction of the heater, wherein the first thermally conductive member includes a first portion having a first hooking portion extending in a direction away from the heater, at an end opposed to the second thermally conductive member in a longitudinal direction, wherein the second thermally conductive member includes a second portion and a second hooking portion, the second portion extending in the direction away from the heater, the second hooking portion being configured to overlap with the first hooking portion of the first thermally conductive member in the longitudinal direction, at an end opposed to the first thermally conductive member in the longitudinal direction, and wherein the support member includes a hole for inserting the first portion of the first thermally conductive member and the second portion and the second hooking portion of the second thermally conductive member.

7. The fixing device according to claim 6, wherein a movement of the second thermally conductive member in a direction away from the support member is regulated by an engagement of the second hooking portion of the second thermally conductive member with the support member, and wherein a movement of the first thermally conductive member in a direction away from the support member is regulated by an engagement of the first hooking portion of the first thermally conductive member with the second hooking portion of the second thermally conductive member.

8. The fixing device according to claim 6, wherein the first and second thermally conductive members are made of metal.

9. The fixing device according to claim 8, wherein the first portion of the first thermally conductive member is a part obtained by bending the first thermally conductive member, and the second portion and the second hooking portion of the second thermally conductive member is a part obtained by bending the second thermally conductive member, and wherein when the first thermally conductive member and the second thermally conductive member are expanded in the direction of approaching each other by heat, the overlap width of the first thermally conductive member and the second hooking portion of the second thermally conductive member in the longitudinal direction extend.

10. The fixing device according to claim 6, wherein the first thermally conductive member includes a first positioning portion for positioning the first thermally conductive member with respect to the support member in the longitudinal direction at a position different from a position of the first portion of the first thermally conductive member, and wherein the second thermally conductive member includes a second positioning portion for positioning the second thermally conductive member with respect to the support member in the longitudinal direction at a position different from a position of the second portion of the second thermally conductive member.

* * * * *